US005738049A

United States Patent [19]

Ninomiya

[11] Patent Number: 5,738,049

[45] Date of Patent: Apr. 14, 1998

[54] APPARATUS FOR DETECTING A MALFUNCTION IN A RADIATOR FAN SYSTEM

[75] Inventor: Masahito Ninomiya, Toyota, Japan

[73] Assignee: Toyota Jidosha Kabushiki Kaisha, Aichi-Ken, Japan

[21] Appl. No.: 697,896

[22] Filed: Sep. 3, 1996

[30] Foreign Application Priority Data

Sep. 11, 1995 [JP] Japan ..... 7-232799

[51] Int. Cl.[6] ..... F01P 5/14

[52] U.S. Cl. ..... 123/41.15

[58] Field of Search ..... 123/41.15, 41.12; 340/444

[56] References Cited

U.S. PATENT DOCUMENTS

| | | | |
|---|---|---|---|
| 4,580,531 | 4/1986 | N'Guyen | 123/41.1 |
| 5,036,803 | 8/1991 | Nolting et al. | 123/41.1 |
| 5,561,243 | 10/1996 | Machida | 123/41.12 |

FOREIGN PATENT DOCUMENTS

| | | |
|---|---|---|
| A-323210 | 7/1989 | European Pat. Off. . |
| 58-96119 | 6/1983 | Japan . |
| 60-132020 | 7/1985 | Japan . |
| 61-102313 | 5/1986 | Japan . |
| A-2172717 | 9/1986 | United Kingdom . |

OTHER PUBLICATIONS

Patent Abstracts of Japan, vol. 014, No. 243 (M-0977), May 23, 1990 & JP-A-02 064329 (NEC Corp), Mar. 5, 1990.

*Primary Examiner*—Noah P. Kamen
*Attorney, Agent, or Firm*—Kenyon & Kenyon

[57] ABSTRACT

A malfunction detecting apparatus of a radiator fan system includes a steady-state discrimination unit which detects whether an operating condition of an internal combustion engine is in a steady state. A temperature change measuring unit measures a change in a temperature of cooling water of the engine when the operating condition of the engine is detected to be in the steady state and a control signal to start rotation of a cooling fan of the radiator fan system is output. A malfunction detecting unit detects that a malfunction in the radiator fan system has occurred when the temperature change measured by the temperature change measuring unit is smaller than a reference value.

15 Claims, 10 Drawing Sheets

COOLING FAN

YFAN
1
0
THW35
THW20
THW35
THW20
FIG. 4C [oc]
THW
THW20
THW35
THW20
THW35

35
CFANON
0

DLTHWF
0

XFANFO
1
0

XFANF
1
0
t1
t1+20
t1+35
t1+70
TIME (sec)
NORMAL CONDITION
NON-START FAILURE

FIG. 7

(sec)

| THWST | 0 ℃ | 20℃ | 60℃ | 80℃ |
|---|---|---|---|---|
| tKAST | 600 | 480 | 300 | 240 |

COOLING FAN

YFAN
FORCED COOLING

THW
THW35A
(THWOA)

70
CFANJA
0
THWOA
THW35A
THW35
THW35A
(THWOA)

CFANON
FORCED COOLING
FORCED COOLING

XFANFAO
OFF
ON

XFANFA
OFF
ON
t1
t2
t3
t3+70
t3+105
t3+140
TIME (sec)
NORMAL CONDITION
NON-STOP FAILURE

COOLING FAN

YFAN
ON
OFF
THW35S (THWOS)
THWOS
THW 35S

THW
96
94.5

70
CFANJS
0

CFANOF

XFANFSO
ON
OFF

XFANFS
ON
OFF
t1 t2 t2+70 t2+105 t2+140
TIME (sec)
NORMAL CONDITION
NON-START FAILURE

APPARATUS FOR DETECTING A MALFUNCTION IN A RADIATOR FAN SYSTEM

BACKGROUND OF THE INVENTION (1) Field of the Invention

The present invention generally relates to a a malfunction detecting apparatus for a radiator fan system, and more particularly to an apparatus for detecting a malfunction such as non-start failure or non-stop failure of a radiator fan system which controls a cooling fan in response to a temperature of cooling water circulated in an internal combustion engine.

(2) Description of the Related Art

Japanese Laid-Open Patent Application No.60-132020 teaches a malfunction detecting apparatus for a radiator fan system of an automotive vehicle. When a malfunction in the radiator fan system is detected, the malfunction detecting apparatus provides a warning of the malfunction to the vehicle operator.

The conventional apparatus disclosed in the above publication requires a special detecting circuit which detects a fuse-out of a fan motor as well as a special detecting circuit which detects a rotation of a radiator fan. By attaching such detecting circuits to the radiator fan system, it is possible for the conventional apparatus to detect whether a malfunction in the radiator fan system has occurred.

Generally, the radiator fan system constitutes part of a cooling system for cooling an internal combustion engine of an automotive vehicle. The radiator fan system generally has a radiator attached to the engine and a cooling fan for cooling the radiator. The heat generated by the engine is delivered to the radiator through the cooling water circulated in the engine. Since the radiator is cooled by, while the vehicle is running, by running air and, while the fan is rotating, by cooling air from the fan, the heat generated by the engine is dissipated to the atmosphere via the radiator so that the cooling water temperature is maintained at an appropriate temperature.

When the radiator fan system is not properly operated and the radiator is not sufficiently cooled by the running air alone, the engine is insufficiently cooled, causing the engine to overheat. In addition, when the rotation of the cooling fan is not properly stopped, the engine is excessively cooled to a low temperature and the heat generated by the engine will be wasted due to the excessive cooling. Thus, when the radiator fan system is not properly operated or the operation of the radiator fan system is not properly stopped, various problems of the automotive vehicle may arise.

If the malfunction detecting apparatus of the radiator fan system is installed on the vehicle, it is possible to give warning of the malfunction in the radiator fan system to the vehicle operator. The vehicle operator can take measures such as stopping the operation of the engine before any problem of the vehicle takes place. Therefore, the conventional apparatus of the above publication allows the vehicle operator to prevent a secondary failure of the vehicle from occurring due to the malfunction of the radiator fan system.

However, the conventional apparatus of the above publication requires a special detecting circuit detecting a fuse-out of the fan motor as well as a special detecting circuit detecting a rotation of the radiator fan, in order to detect a malfunction in the radiator fan system. Such detecting circuits or sensors are unnecessary for the vehicle unless the malfunction detection of the radiator fan system is carried out thereon. In order to employ the conventional apparatus, it is necessary to attach such detecting circuits to the radiator fan system.

Accordingly, there is a problem in that the conventional malfunction detecting apparatus unnecessarily raises the cost of the radiator fan system.

SUMMARY OF THE INVENTION

An object of the present invention is to provide a novel and useful malfunction detecting apparatus for a radiator fan system in which the above-described problems are eliminated.

Another object of the present invention is to provide a malfunction detecting apparatus for a radiator fan system in which a malfunction in the radiator fan system, such as a non-start failure or a non-stop failure, can be accurately detected with no need for a special detecting unit.

The above-mentioned objects of the present invention are achieved by an apparatus for detecting a malfunction in a radiator fan system which controls a cooling fan in response to a temperature of cooling water circulated in an internal combustion engine, which includes: a steady-state discrimination unit detecting whether an operating condition of the engine is in a steady state; a temperature change measuring unit measuring a change in the temperature of the cooling water when the operating condition of the engine is detected to be in the steady state and a control signal to start rotation of the cooling fan is output. A malfunction detecting unit detects that a malfunction in the radiator fan system has occurred when the temperature change measured by the temperature change measuring unit is smaller than a reference value.

Alternatively, the present invention is directed to an apparatus for detecting a malfunction in a radiator fan system which controls a cooling fan in response to a temperature of cooling water circulated in an internal combustion engine, which includes: a steady-state discrimination unit detecting whether an operating condition of the engine is in a steady state; a rotation stopping unit stopping rotation of the cooling fan when the operating condition of the engine is detected to be in the steady state and a control signal to start rotation of the cooling fan is presently output. A temperature change measuring unit measures a change in the temperature of the cooling water after the rotation of the cooling fan is stopped by the rotation stopping unit, and a malfunction detecting unit detects that a malfunction in the radiator fan system has occurred when the temperature change measured by the temperature change measuring unit is smaller than a reference value.

The above-mentioned objects of the present invention are achieved by an apparatus for detecting a malfunction in a radiator fan system which controls a cooling fan in response to a temperature of cooling water circulated in an internal combustion engine, which includes: a steady-state discrimination unit detecting whether an operating condition of the engine is in a steady state; a rotation starting unit starting rotation of the cooling fan when the operating condition of the engine is detected to be in the steady state and a control signal to start rotation of the cooling fan is not presently output. A temperature change measures unit measuring a change in the temperature of the cooling water after the rotation of the cooling fan is started by the rotation starting unit, and a malfunction detecting unit detects that a malfunction in the radiator fan system has occurred, when the temperature change measured by the temperature change measuring unit is smaller than a reference value.

It is possible for the malfunction detecting apparatus of the present invention to correctly detect a non-start failure of the radiator fan system in accordance with the change in the cooling water temperature with high accuracy. The malfunction detecting apparatus of the present invention does not require a special detecting unit for detecting a malfunction in the radiator fan system. Therefore, the present invention provides a low cost a malfunction detecting apparatus which can accurately detect the non-start failure of the radiator fan system.

In addition, it is possible for the malfunction detecting apparatus of the present invention to correctly detect a non-stop failure of the radiator fan system in accordance with the change in the cooling water temperature with high accuracy. The malfunction detecting apparatus of the present invention does not require a special detecting unit for detecting a malfunction in the radiator fan system. Therefore, the present invention provides a low cost a malfunction detecting apparatus which can accurately detect the non-stop failure of the radiator fan system.

BRIEF DESCRIPTION OF THE DRAWINGS

Other objects, features and advantages of the present invention will be more apparent from the following detailed description when read in conjunction with the accompanying drawings in which:

FIGS. 4A through 4G are time charts for explaining an operation of the malfunction detecting apparatus of the first embodiment;

FIG. 7 is a diagram of a map used by the second embodiment;

DETAILED DESCRIPTION OF THE PREFERRED EMBODIMENTS

A description-will now be given of the preferred embodiments of the present invention with reference to the accompanying drawings.

Figure 1:
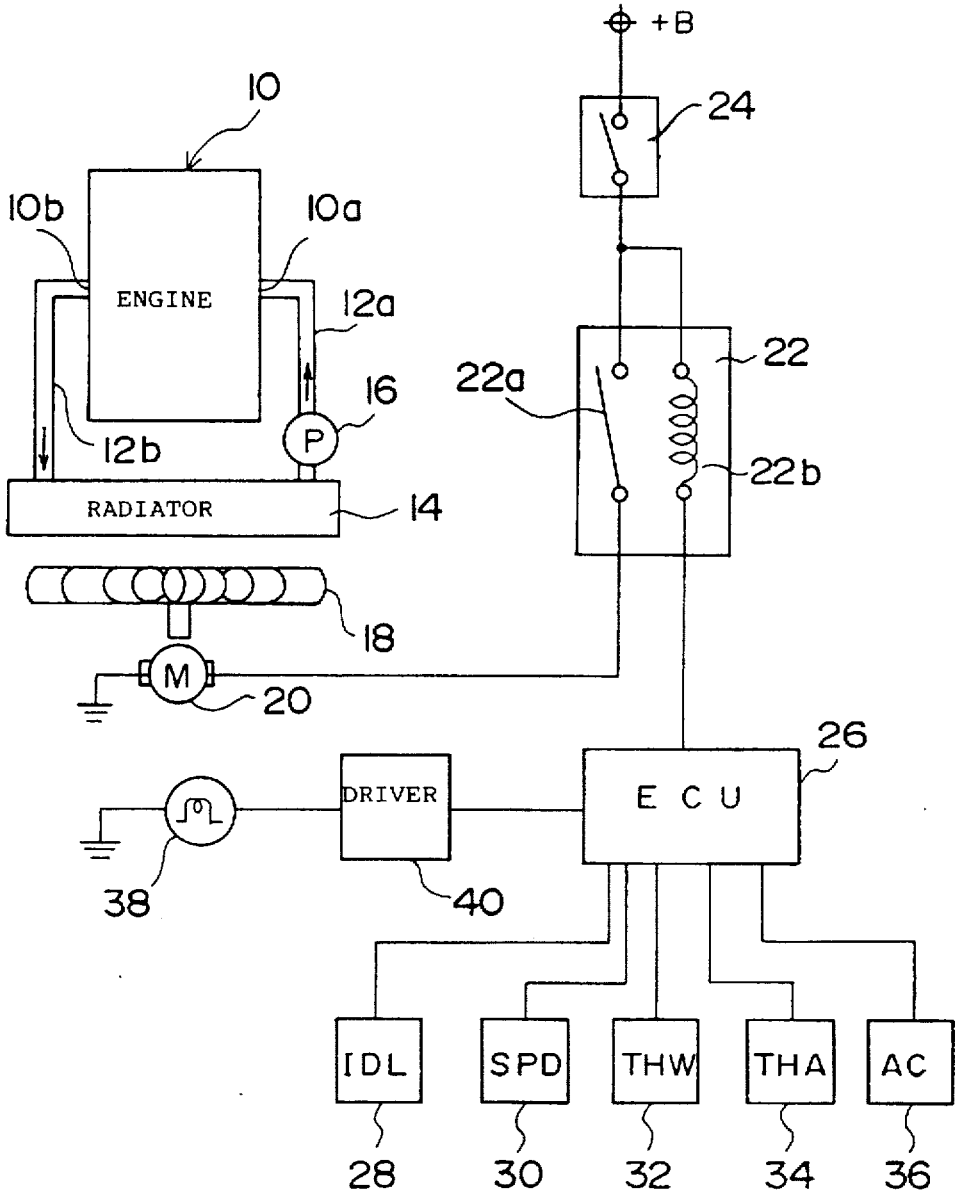
FIG. 1 is a system diagram of a radiator fan system to which the present invention is applied.

FIG. 1 shows a radiator fan system to which the present invention is applied.

Referring to FIG. 1, an internal combustion engine 10 is placed in an engine room of an automotive vehicle. The engine 10 includes a water jacket in which a cooling water is circulated. A radiator 14 is arranged adjacent to the engine 10. A cooling water supply passage **12*a* from the radiator 14 is attached to an inlet 10*a* of the water jacket, and a cooling water return passage 12*b* connected to the radiator 14 is attached to an outlet 10*b*** of the water jacket.

A water pump (P) 16 is arranged at an intermediate portion of the cooling water supply passage **12*a*. The water pump 16 is rotated by using an output torque of the engine 10 in order to pressurize the cooling water. Thus, when the engine 10 is running, the cooling water is pressurized by the water pump 16, and the cooling water under pressure is supplied from the radiator 14 to the engine 10**.

The radiator 14 is arranged in the engine room at a position where through which running air flows. A cooling fan 18 is arranged in the vicinity of the radiator 14. When the cooling fan 18 is rotated, the cooling fan 18 supplies cooling air to the radiator 14. The radiator 14 is cooled by the running air and the cooling air.

A fan motor 20 is coupled to the cooling fan 18 as a power source to rotate the cooling fan 18. The fan motor 20 is a direct-current motor which generates a rotational torque proportional to the applied voltage. The fan motor 20 has one terminal connected to a vehicle body so that the terminal of the fan motor 20 is grounded. The fan motor 20 has the other terminal connected to a radiator fan relay 22.

The radiator fan relay 22 includes a switching device **22*a* and a drive inductor 22*b*. When current is supplied to the inductor 22*b*, the switching device 22*a* is activated by the inductor 22*b* and the switching device 22*a* is turned ON. When no current is supplied to the inductor 22*b*, the switching device 22*a* is not activated by the inductor 22*b* and the switching device 22*a*** is turned OFF.

The switching device **22*a* and the drive inductor 22*b* are both connected to one end of an ignition switch (IG) 24. The ignition switch 24 has another end from which a source voltage (+B) from a battery of the vehicle is supplied. Therefore, when the ignition switch 24 is turned ON, the source voltage (+B) from the battery is supplied to both the switching device 22*a* and the inductor 22*b* via the ignition switch 24**.

When the radiator fan relay 22 operates normally (or no malfunction occurs), the switching device **22*a* is turned OFF when no current is supplied to the inductor 22*b*. In this case, the source voltage (+B) is not supplied to the fan motor 20 via the radiator fan relay 22 even if the ignition switch 24 is turned ON, so that the fan motor 20 does not rotate the cooling fan 18. At this time, the cooling fan 18** stop operation.

Further, when the radiator fan relay 22 operates normally, the switching device **22*a* is turned ON when current is supplied to the inductor 22*b*. In this case, the source voltage (+B) is supplied to the fan motor 20 via the radiator fan relay 22 if the ignition switch 24 is turned ON, so that the cooling fan 18 is rotated by the fan motor 20. AT this time, the cooling fan 18** start operation.

The radiator fan system, as shown in FIG. 1, includes an electronic control unit (ECU) 26 which has an output connected to the drive inductor **22*b* of the radiator fan relay 22. To start rotation of the cooling fan 18, the ECU 26 outputs a low-state signal to the inductor 22*b* to enable current to be supplied to the inductor 22*b*. On the other hand, to stop the rotation of the cooling fan 18, the ECU 26 outputs a high-state signal to the inductor 22*b* to inhibit the supply of current to the inductor 22*b***.

The ECU 26 has various inputs to which various sensing and switching units are connected. As shown in FIG. 1, an idle switch (IDL) 28, a vehicle speed sensor (SPD) 30, a water temperature sensor (THW) 32, an air temperature sensor (THA) 34, and an air conditioner switch (AC) 36 are connected to the inputs of the ECU 26.

The idle switch (IDL) 28 is a switching unit arranged in the vicinity of a throttle valve in an intake passage of the engine 10. The IDL 28 outputs an ON-state signal when the throttle valve is set at its fully-closed position so that the engine 10 is in the idling condition.

The vehicle speed sensor (SPD) 30 is a sensing unit which outputs a pulsed signal having a period that is proportional to a vehicle speed. The ECU 26 is capable of detecting the vehicle speed in response to the frequency of the pulsed signal from the SPD 30.

The water temperature sensor (THW) 32 is a sensing unit arranged in the water jacket of the engine 10. The THW 32 outputs a voltage signal indicative of a temperature of the cooling water circulated in the water jacket of the engine 10.

The air temperature sensor (THA) 34 is a sensing unit arranged in an intake pipe connected to the intake passage of the engine 10. The THA 34 outputs a voltage signal indicative of a temperature of intake air entering the intake pipe into the engine 10.

The air conditioner switch (AC) 36 is a switching unit arranged in an air conditioner of the vehicle. The AC 36 outputs a signal indicative of an operating condition of the air conditioner. The ECU 26 is capable of detecting the operating condition of the air conditioner in response to the signal from the AC 36.

The ECU 26 has another output connected to a driver circuit 40 of a warning lamp 38. The warning lamp 38 is placed on an instrument panel of the vehicle. When a malfunction such as non-start failure or non-stop failure of the radiator fan system has occurred, the warning lamp 38 is turned ON to provide a warning of the malfunction of the radiator fan system to the vehicle operator. The ECU 26 outputs an ON-state signal to the driver circuit 40 when a malfunction in the radiator fan system is detected.

As described above, the radiator fan system to which the present invention is applied includes various sensing and switching units which monitor a running condition of the vehicle. However, it does not include a special detecting unit for detecting a malfunction in the radiator fan system. The malfunction detecting apparatus of the present invention detects a malfunction in the radiator fan system by performing the following routines without using a special detecting unit for detecting a fuse-out of the fan motor 20 or for detecting the rotation of the cooling fan 18.

Figure 2:
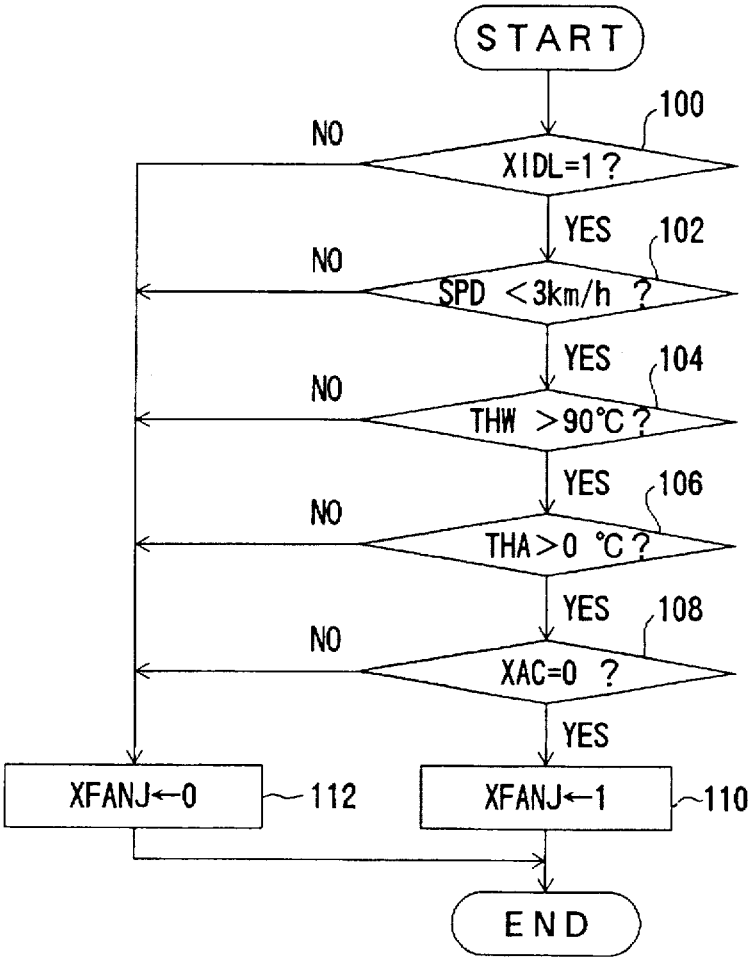
FIG. 2 is a flowchart for explaining a steady-state discrimination routine performed by a malfunction detecting apparatus in a first embodiment of the present invention.

FIG. 2 shows a steady-state discrimination routine performed by a malfunction detecting apparatus in a first embodiment of the present invention.

The steady-state discrimination routine shown in FIG. 2 is executed by the ECU 26 of the radiator fan system. This routine is performed to detect, prior to the malfunction detection, whether an operating condition of the engine 10 conforms with a predetermined reference condition. When the operating condition of the engine 10 is detected as conforming with the reference condition, it is determined whether the cooling water temperature (THW) accurately varies in accordance with a reference profile regardless of whether the radiator fan system is operating or not.

The steady-state discrimination routine shown in FIG. 2 is performed by the ECU 26 at given intervals of time. When this routine is started, the ECU 26 at step 100 detects whether an idle switch flag (XIDL) is equal to one "1".

When the ON-state signal from the idle switch 28 is output to the ECU 26, the idle switch flag (XIDL) is set at one "1". Otherwise the idle switch flag (XIDL) is set at zero "0". Therefore, when the idle switch flag XIDL is equal to 1, it indicates that the engine 10 is operating in the idling condition. The heat generated and dissipated by the engine 10 at this time is in the steady state. It can be determined whether the cooling water temperature (THW) accurately varies in accordance with the reference profile. Thus, when the result at the step 100 is affirmative (XIDL=1), step 102 is performed.

Step 102 detects whether the vehicle speed (SPD) indicated by the signal from the vehicle speed sensor 30 is below 3 km/h. When the vehicle speed (SPD) is below 3 km/h, the influence of the running air on the cooling water temperature (THW) is negligible. The change in the cooling water temperature (THW) is primarily influenced by the operating condition of the cooling fan 18. It can be determined that the cooling water temperature (THW) accurately varies in accordance with the reference profile. Thus, when the result at the step 102 is affirmative (SPD<3 km/h), step 104 is performed.

Step 104 detects whether the cooling water temperature (THW) indicated by the signal from the water temperature sensor 32 is above 90° C. When the cooling water temperature (THW) is below 90° C., the rotation of the cooling fan 18 is not started, and the change in the cooling water temperature (THW) is influenced by the heat generated and dissipated by the engine 10 which varies transiently. Thus, when the cooling water temperature (THW) is below 90° C., the reference profile does not accurately portray the variations in the cooling water temperature (THW).

On the other hand, when the cooling water temperature (THW) is above 90° C., it is determined that the cooling water temperature (THW) accurately varies in accordance with the reference profile. Thus, when the result at the step 104 is affirmative (THW>90° C.), step 106 is performed.

Step 106 detects whether the intake air temperature (THA) indicated by the signal from the intake air temperature sensor 34 is above 0° C. When the intake air temperature (THA) is below 0° C., the engine 10 is easily cooled by the external air. The operation of the cooling fan 18 is hardly started, and the cooling water temperature (THW) does not accurately vary in accordance with the reference profile.

When the intake air temperature (THA) is above 0° C., the influence of the external air on the change in the cooling water temperature (THW) is negligible. It is determined that the cooling water temperature (THW) accurately varies in accordance with the reference profile. When the result at the step 106 is affirmative, step 108 is performed.

Step 108 detects whether an air conditioner flag (XAC) is equal to zero "0". The air conditioner flag XAC is set at one "1" when the ON-state signal from the air conditioner switch 36 is output to the ECU 26. Otherwise the air conditioner flag XAC is set at zero "0".

In the present embodiment, when the air conditioner flag XAC is set at one, the air conditioner starts operating and the rotation of the cooling fan 18 at the driving voltage of 6 V is started. When the air conditioner is operating, the cooling water temperature (THW) does not accurately vary in accordance with the reference profile.

On the other hand, when the air conditioner flag XAC is equal to 0, it is determined that the cooling water temperature (THW) accurately varies in accordance with the reference profile. Thus, when the result at the step 108 is affirmative (XAC=0), step 110 is performed.

As shown in FIG. 2, when all the requirements of the above steps 100 through 108 are met, step 110 is performed.

In the present embodiment, when all these requirements are met, it is determined that the cooling water temperature (THW) accurately varies in accordance with the reference profile. Step 110 sets a steady-state flag XFANJ at one "1". When the steady-state flag XFANJ is equal to 1, it indicates that the operating condition of the engine 10 is detected as conforming with the reference condition. As the result of the steady-state discrimination routine shown in FIG. 2, it is determined that the cooling water temperature (THW) accurately varies in accordance with the reference profile.

When at least one of the requirements of the above steps 100 through 108 is not met, step 112 is performed. Step 112 sets the steady-state flag XFANJ at zero "0". When the steady-state flag XFANJ is equal to 0, it indicates that the operating condition of the engine 10 is not in conformity with the reference condition. As the result of the steady-state discrimination routine shown in FIG. 2, it is determined that the cooling water temperature (THW) does not accurately vary in accordance with the reference profile.

Accordingly, by checking the value of the steady-state flag XFANJ after the steady-state discrimination routine is performed, it can be determined whether the cooling water temperature (THW) accurately varies in accordance with the reference profile.

Figure 3:
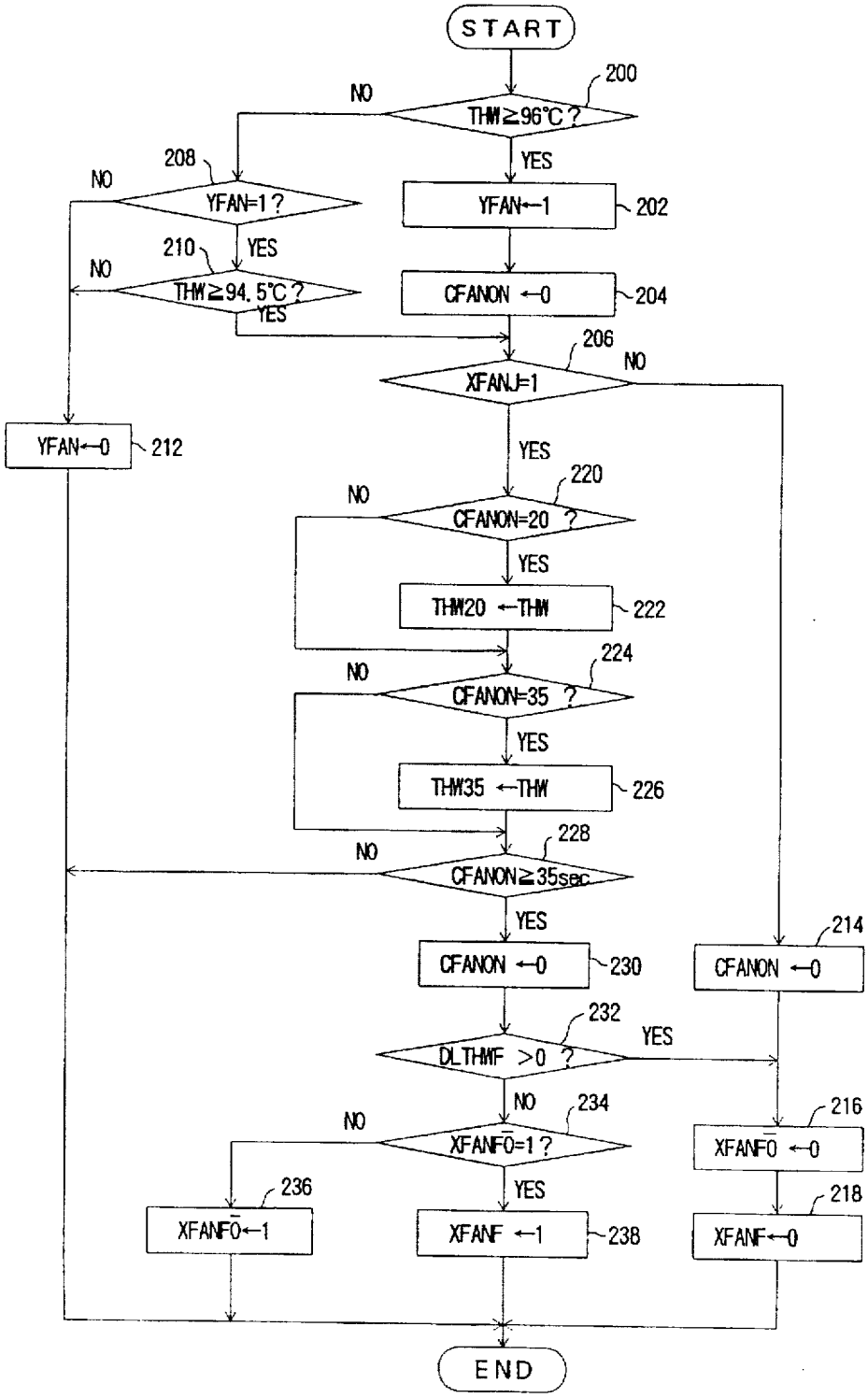
FIG. 3 is a flowchart for explaining a malfunction detecting routine performed by the malfunction detecting apparatus of the first embodiment.

FIG. 3 shows a malfunction detection routine performed by the malfunction detecting apparatus of the first embodiment.

The malfunction detection routine in FIG. 3 is executed by the ECU 26 of the radiator fan system in FIG. 1. This routine is performed in order to control the operation of the radiator fan system including the cooling fan 18, and detect whether a non-start failure in the radiator fan system has occurred.

In the following, non-start failure means a malfunction of the radiator fan system in which the rotation of the cooling fan 18 cannot be started even though the low-state signal from the ECU 26 is output to the radiator fan relay 22.

The execution of the malfunction detection routine in FIG. 3 is repeated at given intervals of time after the ignition switch 24 is turned ON. When this routine is started, the ECU 26 at step 200 detects whether the cooling water temperature (THW) indicated by the signal from the water temperature sensor 32 is above 96° C.

When the result at the step 200 is affirmative (THW≧96° C.), step 202 is performed. Step 202 sets a radiator fan relay flag YFAN at one "1".

If the radiator fan relay flag YFAN is set at one, the ECU 26 outputs the low-state signal to the inductor **22*b* of the radiator fan relay 22. When the radiator fan relay 22, the fan motor 20, and the connection between the elements are normal and no malfunction occurs, the rotation of the cooling fan 18 is started immediately by outputting the low-state signal to the inductor 22*b* of the radiator fan relay 22**.

After step 202 is performed, step 204 is performed. Step 204 sets a time counter CFANON at zero "0". The time counter CFANON is automatically incremented for every second after it is set at zero, until the elapsed time is equal to 35 seconds.

After step 204 is performed, step 206 is performed. Step 206 will be described later.

When the result at step 200 is negative (THW<96° C.), step 208 is performed and the steps 202 and 204 are not performed. Step 208 detects whether the radiator fan relay flag YFAN is equal to 1.

When the result at step 208 is affirmative (YFAN=1), step 210 is performed. It is determined that the engine 10 is currently cooled by the cooling fan 18. Step 210 detects whether the cooling water temperature (THW) indicated by the signal from the water temperature sensor 32 is above 94.5° C. When the result at the step 210 is affirmative (THW≧94.5° C.), it is determined that the engine 10 has not been cooled to a sufficiently low temperature. Step 206 is performed at this time and the radiator fan relay flag YFAN is maintained at 1.

When the result at step 208 is negative (YFAN not equal to 1) or when the result at the step 210 is negative (THW<94.5° C.), step S212 is performed. It is determined that starting the rotation of the cooling fan 18 is not needed. Step 212 sets the radiator fan relay flag YFAN at zero. After step 212 is performed, the malfunction detection routine at the present cycle ends.

If the radiator fan relay flag YFAN is set at zero, the ECU 26 outputs the high-state signal to the inductor **22*b* of the radiator fan relay 22. When the radiator fan relay 22, the fan motor 20, and the connection between the elements are normal and no malfunction occurs, the switching device 22*a* of the radiator fan relay 22 is turned OFF. Accordingly, the rotation of the cooling fan 18 is stopped immediately by outputting the high-state signal to the inductor 22*b* of the radiator fan relay 22**.

According to the above procedure, the rotation of the cooling fan 18 is continuously stopped until the cooling water temperature (THW) is raised to the upper limit temperature 96° C. If the cooling water temperature (THW) reaches 96° C., the rotation of the cooling fan 18 is started and maintained until the cooling water temperature (THW) is lowered to the lower limit temperature 94.5° C. Since the rotation of the cooling fan 18 is controlled, the cooling water temperature (THW) is maintained in the range between the lower limit temperature and the upper limit temperature (94.5° C.–96° C.).

As described above, when the radiator fan relay flag YFAN is maintained at 1, step 206 is always performed by the ECU 26. Step 206 detects whether the steady-state flag XFANJ is equal to 1. That is, it is determined at this step whether the cooling water temperature (THW) accurately varies in accordance with the reference profile.

When the result at step 206 is negative (XFANJ not equal to 1), step 214 is performed. It is determined that for a certain reason the cooling water temperature (THW) does not accurately vary in accordance with the reference profile. It is difficult at this time to carry out the malfunction detection of the radiator fan system. Step 214 sets the time counter CFANON at zero.

After step 214 is performed, steps 216 and 218 are performed. Step 216 sets a temporary failure flag XFANF0 at zero. Step 218 sets a failure flag XFANF at zero. After step 218 is performed, the malfunction detecting routine at the present cycle ends.

When the result at step 206 is affirmative (XFANJ=1), step 220 is performed. It is determined that the cooling water temperature (THW) accurately varies in accordance with the reference profile. Step 220 detects whether the time counter CFANON is equal to 20 (or whether the elapsed time is equal to 20 seconds).

When the time counter CFANON is equal to 20, step 222 is performed. Step 222 sets a 20-second-after temperature value THW20 at the cooling water temperature of the present time. That is, the value of the cooling water temperature (THW) at the time 20 seconds has elapsed since the start of the rotation of the cooling fan 18 is stored in a memory of the ECU 26.

When the time counter CFANON is not equal to 20, step 224 is performed and step 222 is not performed. Step 224 detects whether the time counter CFANON is equal to 35 (or whether the elapsed time is equal to 35 seconds).

When the time counter CFANON is equal to 35, step 226 is performed. Step 226 sets a 35-second-after temperature value THW35 at the cooling water temperature of the present time. That is, the value of the cooling water temperature (THW) at the time 35 seconds has elapsed since the start of the rotation of the cooling fan 18 is stored in the memory of the ECU 26.

When the time counter CFANON is not equal to 35, step 228 is performed and step 226 is not performed. Step 228 detects whether the time counter CFANON is greater than or equal to 35. When the result at step 228 is negative (CFANON<35), the malfunction detecting routine at the present cycle ends. That is, when CFANON<35, steps 200 through 228 are repeated.

When the result at step 228 is affirmative (CFANON≧35), step 230 is performed. Step 230 sets the time counter CFANON at zero.

After step 230 is performed, step 232 is performed. Step 232 detects whether a temperature change DLTHWF (=THW20–THW35), that is the difference between the 20-second-after temperature value THW20 and the 35-second-after temperature value THW35, is greater than zero (or whether the temperature change is a positive value).

As described above, the steps 206 through 230 are performed under the condition in which the radiator fan relay flag YFAN is maintained at 1. When steps 206 through 230 are performed, the low-state signal from the ECU 26 is output to the radiator fan relay 22 so that the rotation of the cooling fan 18 is started and maintained to cool the engine 10. If the radiator fan system is normally operating, the cooling water temperature (THW) must be lowered. In this case, the temperature change DLTHWF must be a positive value when no malfunction in the radiator fan system occurs.

On the other hand, if the non-start failure of the radiator fan system has occurred, the cooling water temperature (THW) is raised even though the radiator fan relay flag YFAN is maintained at 1. In this case, the temperature change DLTHWF may be a negative value or equal to zero.

Accordingly, when the result at step 232 is affirmative (DLTHWF>0), it can be determined that the radiator fan system is normally operating. Steps 216 and 218 are performed so that both the temporary failure flag XFANF0 and the failure flag XFANF are set at zero. After step 218 is performed, the malfunction detecting routine at the present cycle ends.

When the result at step 232 is negative (DLTHWF≦0), it can be determined that the non-start failure of the radiator fan system has occurred. Step 234 detects whether the temporary failure flag XFANF0 is equal to 1.

When the result at step 234 is negative (XFANF0 not equal to 1), step 236 sets the temporary failure flag XFANF0 at one. After step 236 is performed, the malfunction detecting routine at the present cycle ends.

When the result at step 234 is affirmative (XFANF0=1), step 238 sets the failure flag XFANF at one. After step 238 is performed, the malfunction detecting routine at the present cycle ends.

According to the above procedure, the failure flag XFANF is set at one when the result at step 232 is negative (DLTHWF≦0) at two consecutive cycles under the condition in which the radiator fan relay flag YFAN is maintained at one. In the present embodiment, the above procedure is carried out in order to ensure the correctness of the malfunction detection and avoid an erroneous determination.

When the failure flag XFANF is set at one as the result of the above malfunction detection routine, the ECU 26 outputs the ON-state signal to the driver circuit 40. The warning lamp 38 is turned ON to give a warning of the malfunction of the radiator fan system to the vehicle operator.

In the present embodiment, the above procedure is carried out in order to ensure high accuracy of the malfunction detection. However, the present invention is not limited to this embodiment. It may be possible to modify the present embodiment so that the failure flag XFANF is set at one when the result at the step 232 is negative (DLTHWF≦0) at first.

FIGS. 4A through 4G are time charts for explaining an operation of the malfunction detecting apparatus of the first embodiment. In FIGS. 4A through 4G, a change of a state when the radiator fan system is normally operating is indicated by a solid line, and a change of a state when the non-start failure of the radiator fan system has occurred is indicated by a single dotted chain line.

Figures 4A, 4B, 4D, 4E, 4F, 4G:
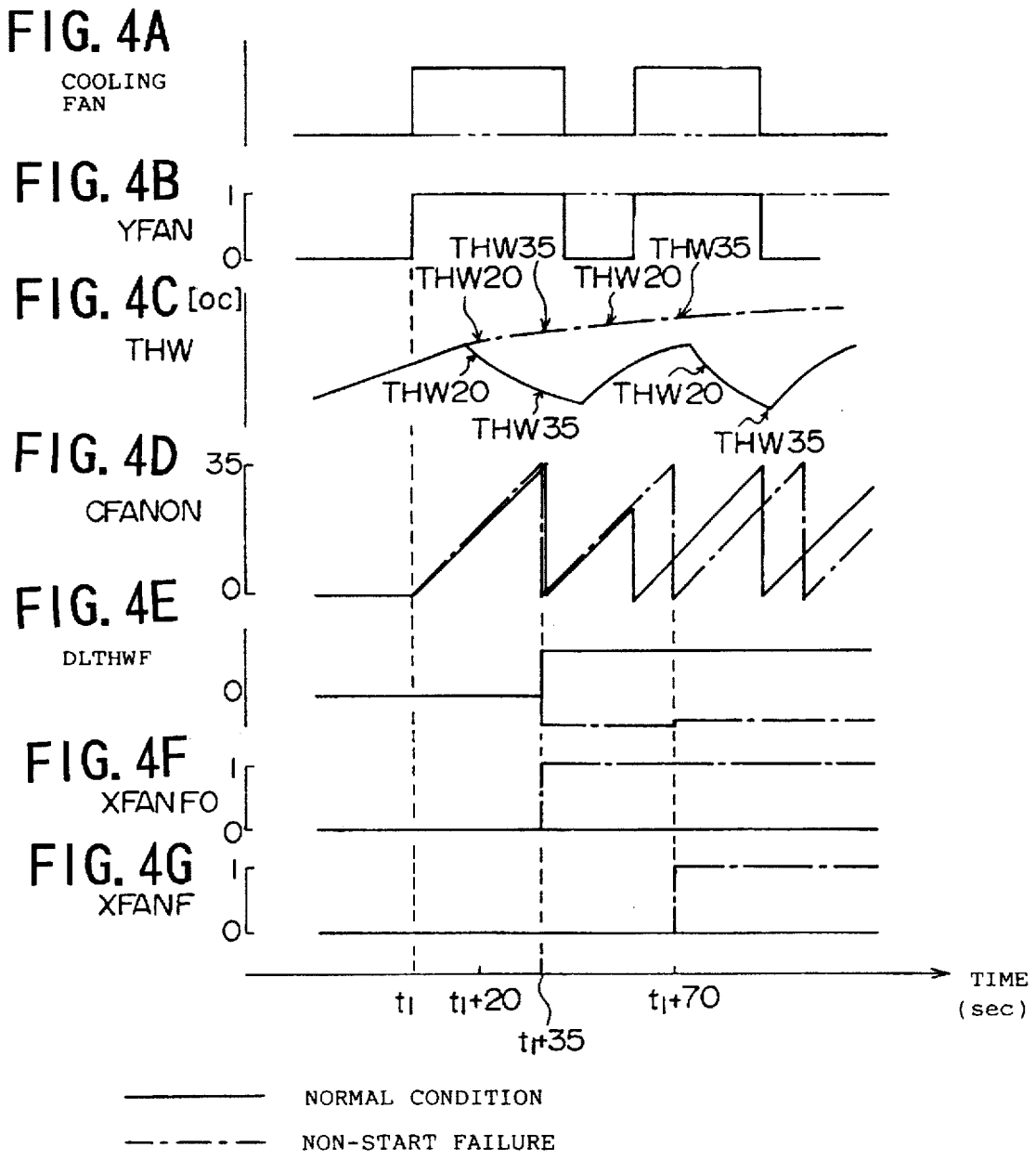

FIG. 4A shows the change of the operation of the cooling fan 18, and FIG. 4B shows the change of the radiator relay flag YFAN. If the radiator fan system is normally operating, when the radiator fan relay flag YFAN changes from 0 to 1 at the time (t1), the cooling fan 18 starts operation in response to the change of the radiator relay flag YFAN.

If the non-start failure of the radiator fan system has occurred, when the radiator fan relay flag YFAN changes from 0 to 1 at the time (t1), the cooling fan 18 does not start operation and remains in the non-rotated condition.

FIG. 4C shows the change of the cooling water temperature THW, and FIG. 4D shows the change of the time counter CFANON. If the radiator fan system is normally operating and the cooling fan 18 starts operation at the time (t1), the cooling water temperature THW is slightly raised due to the heat radiation delay and is thereafter lowered by the rotation of the cooling fan 18. In this case, the 35-second-after temperature value THW35 at the time (t1+35) is smaller than the 20-second-after temperature value THW20 at the time (t1+20).

If the non-start failure of the radiator fan system has occurred and the cooling fan 18 does not start operation at the time (t1), the cooling water temperature THW is continuously raised to the upper saturation temperature. For this reason, the 35-second-after temperature value THW35 is greater than the 20-second-after temperature value THW20.

FIG. 4E shows the change of the temperature change DLTHWF, FIG. 4F shows the change of the temporary failure flag XFANF0, and FIG. 4G shows the change of the failure flag XFANF. If the radiator fan system is normally operating, the cooling water temperature THW changes so as to meet the condition of THW20>THW35 as described above. In this case, the temperature change DLTHWF (=THW20–THW35) is always a positive value. The temporary failure flag XFANF0 and the failure flag XFANF are maintained at 0.

If the non-start failure of the radiator fan system has occurred, the cooling water temperature THW changes so as to meet the condition of THW20<THW35 as described above. In this case, the temperature DLTHWF becomes a negative value at the time (t1+35). The temporary failure flag XFANF0 is set at 1 at the time (t1+35), and the failure flag XFANF is set at 1 at the time (t1+70).

Accordingly, it is possible for the present embodiment to correctly detect the non-start failure of the radiator fan system in accordance with the change in the cooling water temperature THW. The malfunction detecting apparatus of the present embodiment does not require a special detecting unit for detecting a malfunction in the radiator fan system. Therefore, the present embodiment provides a low cost a malfunction detecting apparatus which can correctly detect the non-start failure of the radiator fan system with.

It is readily understood that the malfunction detecting apparatus of the present embodiment comprises a steady-state discrimination unit, a temperature change measuring unit, and a malfunction detecting unit. The steps 100 through 108 in FIG. 2 are performed by the ECU 26 to achieve the steady-state discrimination unit. The step 206 and the steps 220 through 226 in FIG. 3 are performed by the ECU 26 to achieve the temperature change measuring unit. The steps 232 through 238 in FIG. 3 are performed to achieve the malfunction detecting unit.

Further, it is readily understood that the radiator fan system to which the present embodiment is applied comprises a cooling fan control unit controlling the cooling fan 18 by outputting a control signal to the radiator fan relay 22. The steps 200 and 202 and the steps 208 through 212 in FIG. 2 are performed by the ECU 26 to achieve the cooling fan control unit.

Next, a description will be given of a malfunction detecting apparatus in a second embodiment of the present invention with reference to FIGS. 5 through 10G.

The malfunction detection in the second embodiment is also achieved by using the radiator fan system in FIG. 1. By performing the following routines which are different from the routines of the first embodiment, the malfunction detecting apparatus of the second embodiment detects a malfunction in the radiator fan system, such as a non-start failure or a non-stop failure.

In the following, non-stop failure means a malfunction of the radiator fan system in which the rotation of the cooling fan 18 cannot be stopped even though the high-state signal from the ECU 26 is output to the radiator fan relay 22.

Figure 5:
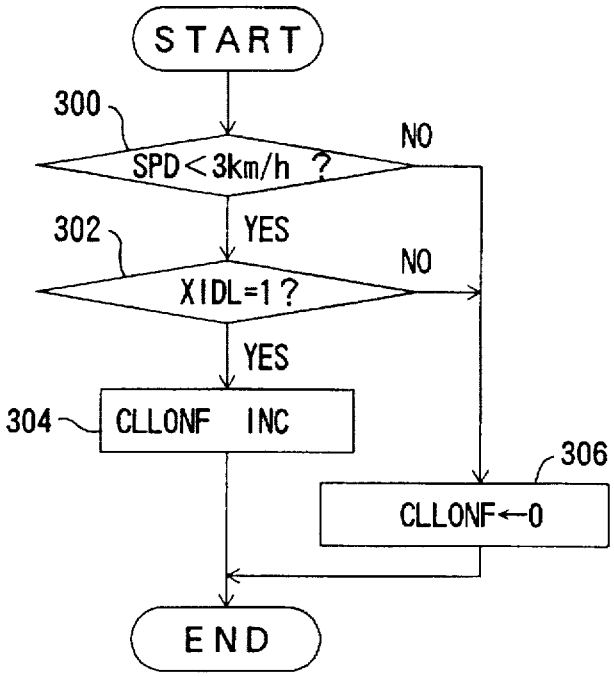
FIG. 5 is a flowchart for explaining a steady-state discrimination routine performed by a malfunction detecting apparatus in a second embodiment of the present invention.

FIG. 5 shows a steady-state discrimination routine performed by the malfunction detecting apparatus of the second embodiment.

The steady-state discrimination routine shown in FIG. 5 is executed by the ECU 26 of the radiator fan system in FIG. 1. This routine is performed to measure a time during which an operating condition of the engine 10 is continuously in conformity with a predetermined reference condition. As previously described, when the operating condition of the engine 10 is detected as conforming with the reference condition, it is determined that the cooling water temperature (THW) accurately varies in accordance with a reference profile regardless of whether the radiator fan system is operating or not. The operating condition of the engine 10 which is in conformity with the reference condition is called the steady state.

The steady-state discrimination routine shown in FIG. 5 is performed by the ECU 26 at given intervals of time. For example, this routine is performed for every second.

When the steady-state discrimination routine is started, the ECU 26 at step 300 detects whether the vehicle speed (SPD) indicated by the signal from the vehicle speed sensor 30 is below 3 km/h.

When the vehicle speed (SPD) is below 3 km/h, the influence of the running air on the change in the cooling water temperature (THW) is negligible. The change in the cooling water temperature (THW) is primarily influenced by the operating condition of the cooling fan 18. It is determined that the heat generated and dissipated by the engine 10 is in the steady state, and that the cooling water temperature (THW) accurately varies in accordance with the reference profile. Thus, when the result at the step 300 is affirmative (SPD<3 km/h), step 302 is performed.

Step 302 detects whether the idle switch flag XIDL is equal to 1. As previously described, the idle switch flag XIDL is set at one when the ON-state signal from the idle switch 28 is output to the ECU 26. When XIDL=1, it is determined that the heat generated and dissipated by the engine 10 is in the steady state, and that the cooling water temperature (THW) accurately varies in accordance with the reference profile.

When the result at the step 302 is affirmative (XIDL=1), step 304 is performed. Step 304 increments a steady-state time counter CLLONF (CLLONF=CLLONF+1). The value of the steady-state time counter CLLONF indicates the time the operating condition of the engine 10 is continuously in the steady state. After the step 304 is performed, the steady-state discrimination routine at the present cycle ends.

When the result at the step 300 is negative (SPD≧3 km/h) or when the result at the step 302 is negative (XIDL not equal to 1), step 306 is performed. Step 306 sets the steady-state time counter CLLONF at zero. After the step 306 is performed, the steady-state discrimination routine at the present cycle ends.

According to the above procedure, the value of the steady-state time counter CLLONF, as the result of the steady-state discrimination routine, indicates the time during which the operating condition of the engine 10 is continuously in the steady state.

Figure 6:
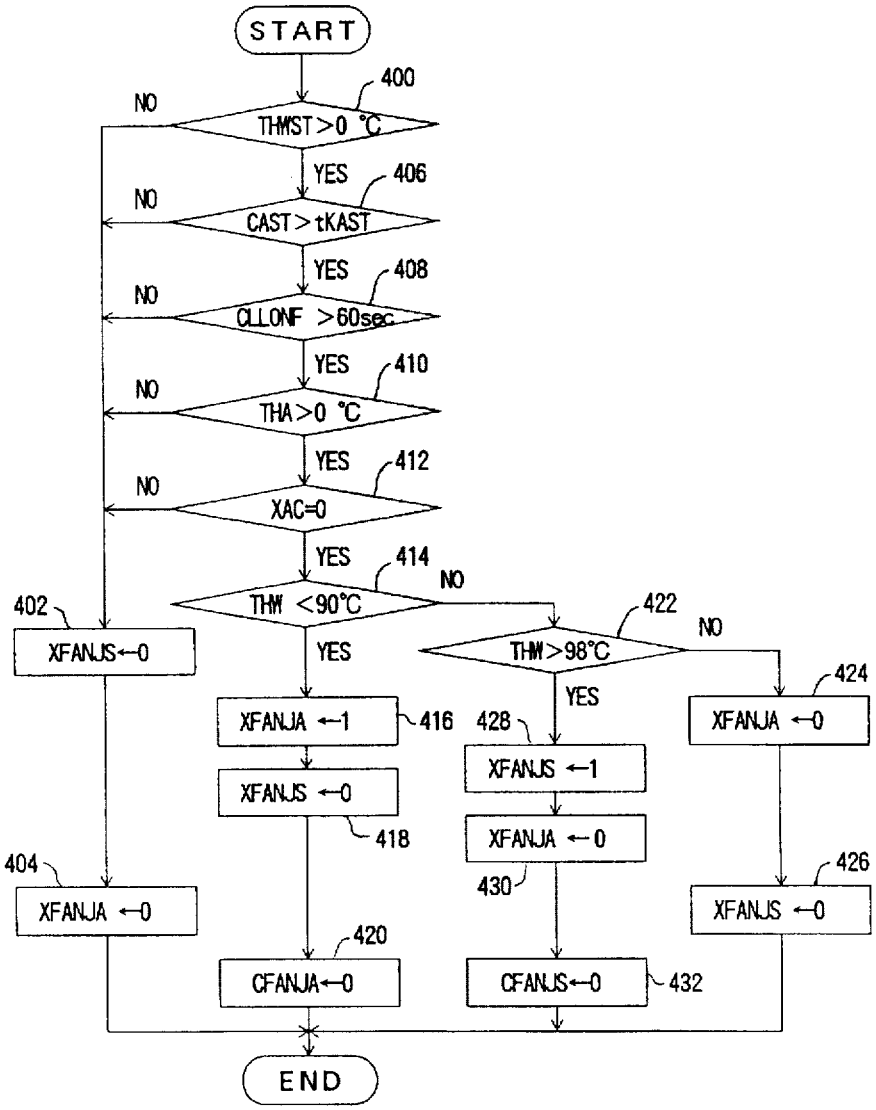
FIG. 6 is a flowchart for explaining a malfunction flag setting routine performed by the second embodiment.

FIG. 6 shows a malfunction flag setting routine performed by the second embodiment.

The malfunction flag setting routine in FIG. 6 is performed by the ECU 26 of the radiator fan system in FIG. 1 to set a non-stop failure flag XFANJA and a non-start failure flag XFANJS. As the result of the malfunction flag setting routine, it is determined whether the operating condition of the engine 10 is in the steady state, and it is determined whether the cooling water temperature THW accurately varies in accordance with the reference profile.

Further, if there is a possibility that the non-stop failure of the radiator fan system has occurred, the non-stop failure flag XFANJA is set at one as the result of the malfunction flag setting routine. If there is a possibility that the non-start failure of the radiator fan system has occurred, the non-start failure flag XFANJS is set at one as the result of the malfunction flag setting routine.

The malfunction flag setting routine in FIG. 6 is performed by the ECU 26 at given intervals of time. When this routine is started, step 400 detects whether a cooling water temperature THWST at the start of the operation of the engine 10 is above 0° C.

When the result at step 400 is negative (THWST≦0° C.), the rotation of the cooling fan 18 is hardly started. It is determined that the operating condition of the engine 10 is unsuited to the malfunction detection. Step 402 sets the non-start failure flag XFANJS at zero. Step 404 sets the non-stop failure flag XFANJA at zero. After step 404 is performed, the malfunction flag setting routine at the present cycle ends.

When the result at step 400 is affirmative (THWST>0° C.), step 406 is performed. Step 406 detects whether a time CAST that has elapsed since the start of the operation of the engine 10 is above a threshold value tKAST. The threshold value tKAST is predetermined as the time needed to complete the idling of the engine 10 since the start of the operation of the engine 10.

FIG. 7 shows a map used by the second embodiment to determine the threshold value tKAST. The map shown in FIG. 7 defines a relationship between the cooling water temperature THWST and the threshold value tKAST. As indicated in FIG. 7, the lower the cooling water temperature THWST is, the greater the threshold value tKAST is.

In step 406, the threshold value tKAST is determined in response to the cooling water temperature THWST by using the map in FIG. 7. After the threshold value tKAST is determined, it is detected whether the time CAST is above the determined threshold value THWST.

When the result at step 406 is negative (CAST≦tKAST), it is determined that the engine 10 is still in process of idling. In this case, the operating condition of the engine 10 is unsuited to the malfunction detection. Steps 402 and 404 are performed, and the routine at the present cycle ends.

When the result at step 406 is affirmative (CAST>tKAST), step 408 is performed. Step 408 detects whether the steady-state time counter CLLONF is above 60 seconds. That is, it is determined whether the time the engine 10 is continuously in the steady state is above 60 seconds. When CLLONF≦60 seconds, it is determined that the cooling water temperature THW does not accurately vary in accordance with the reference profile. Steps 402 and 404 are performed, and the routine at the present cycle ends.

When the result at step 408 is affirmative (CLLONF>60 seconds), step 410 is performed. It is determined that the cooling water temperature THW accurately varies in accordance with the reference profile. Step 410 detects whether the intake air temperature (THA) indicated by the signal from the air temperature sensor 34 is above 0° C. When THA≦0° C., the change in the cooling water temperature (THW) is influenced by the external air and the rotation of the cooling fan 18 is hardly started. In this case, the operating condition of the engine 10 is unsuited to the malfunction detection. Steps 402 and 404 are performed, and the routine at the present cycle ends.

When the result at step 410 is affirmative (THA>0° C.), step 412 is performed. Step 412 detects whether the air conditioner flag XAC set by the signal from the air conditioner switch 36 is equal to 0. When the flag XAC is not equal to 0, the air conditioner is operating and the change in the cooling water temperature THW is influenced by the operation of the air conditioner, which is unsuited to the malfunction detection. In this case, steps 402 and 404 are performed, and the routine at the present cycle ends.

When the result at step 412 is affirmative (XAC=0), step 414 is performed. It is determined that the cooling water temperature THW accurately varies in accordance with the reference profile. Step 414 detects whether the cooling water temperature THW indicated by the signal from the water temperature sensor 32 is below 90° C. Step 414 is performed under the condition in which the idling of the engine 10 is completed.

Similarly to the first embodiment, the cooling fan 18 in the present embodiment is controlled so that the cooling water temperature THW is maintained in the range between the lower limit temperature and the upper limit temperature (94.5° C.–96° C.). Thus, at the time step 414 is performed, it can be determined that the cooling water temperature THW is in the range between 94.5° C. and 96° C. if the cooling fan 18 is normally operating.

When the result at step 414 is affirmative (THW<90° C.), step 416 is performed. It is determined that there is a possibility that the non-stop failure of the radiator fan system has occurred. Step 416 sets the non-stop failure flag XFANJA at one (XFANJA=1). Step 418 sets the non-start failure flag XFANJS at zero (XFANJS=0). Step 420 sets a time counter CFANJA at zero (CFANJA=0). The time counter CFANJA is automatically incremented for every second since the non-stop failure flag XFANJA is set at one, and it indicates the elapsed time since the non-stop failure flag XFANJA is set at one. After step 420 is performed, the routine at the present cycle ends.

When the result at step 414 is negative (THW≧90° C.), step 422 is performed. Step 422 detects whether the cooling water temperature THW indicated by the signal from the water temperature sensor 32 is above 98° C. As described above, it can be determined that the cooling water temperature THW at this time is in the range between 94.5° C. and 96° C. if the cooling fan 18 is normally operating.

When the result at step 422 is negative (THW≦98° C.), it is determined that the radiator fan system is normally operating. In this case, step 424 sets the non-stop failure flag XFANJA at zero (XFANJA=0). Step 426 sets the non-start failure flag XFANJS at zero (XFANJS=0). After step 426 is performed, the routine at the present cycle ends.

When the result at step 422 is affirmative (THW>98° C.), it is determined that there is a possibility that the non-start failure of the radiator fan system has occurred. In this case, step 428 sets the non-start failure flag XFANJS at one (XFANJS=1). Step 430 sets the non-stop failure flag XFANJA at zero (XFANJA=0). Step 432 sets a time counter CFANJS at zero (CFANJS=0). The time counter CFANJS is automatically incremented for every second since the non-start failure flag XFANJS is set at one, and it indicates the elapsed time since the non-start failure flag XFANJS is set at one. After step 432 is performed, the routine at the present cycle ends.

According to the above procedure, if it is detected that the cooling water temperature THW is maintained in the range between the lower limit temperature and the upper limit temperature (94.5° C.–96° C.) under the condition in which the idling of the engine 10 may be completed, the non-start failure flag XFANJS is set at zero and the non-stop failure flag XFANJA is set at zero. If the cooling water temperature THW is detected as being excessively low, the non-stop failure flag XFANJA is set at one. If the cooling water temperature THW is detected as being excessively high, the non-start failure flag XFANJS is set at one. Therefore, by checking the values of the non-stop failure flag XFANJA and the non-start failure flag XFANJS after the malfunction flag setting routine in FIG. 6 is performed, the ECU 26 can determine whether a malfunction in the radiator fan system has occurred.

Figure 8:
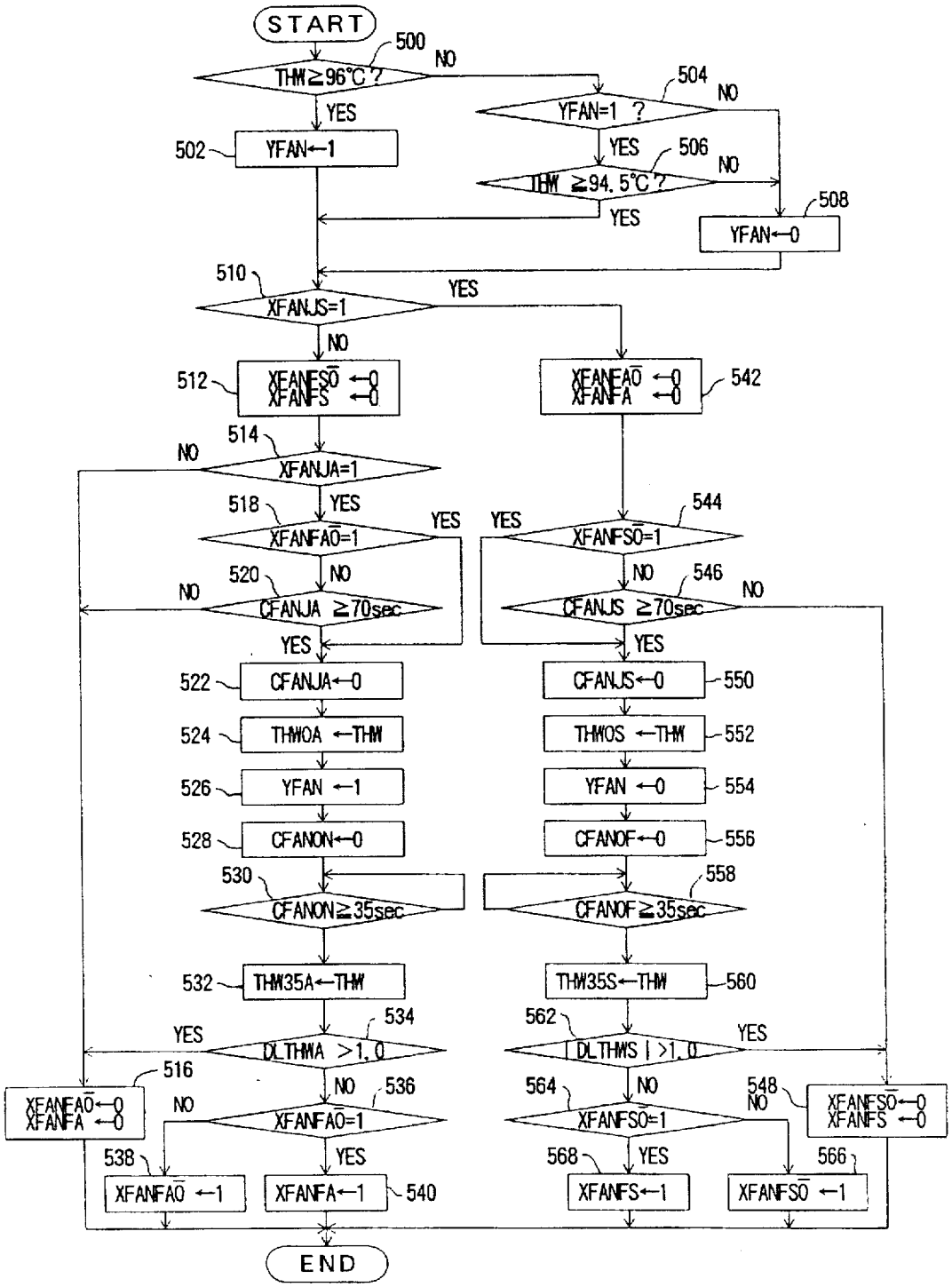
FIG. 8 is a flowchart for explaining a malfunction detecting routine performed by the second embodiment.

FIG. 8 shows a malfunction detection routine performed by the second embodiment.

The malfunction detection routine in FIG. 8 is executed by the ECU 26 of the radiator fan system in FIG. 1. This routine is performed in order to control the operation of the radiator fan system including the cooling fan 18, and detect whether the non-stop failure and/or the non-start failure in the radiator fan system has occurred.

The execution of the malfunction detection routine in FIG. 8 is repeated at given intervals of time after the ignition switch 24 is turned ON. When this routine is started, the ECU 26 at step 500 detects whether the cooling water temperature (THW) indicated by the signal from the water temperature sensor 32 is above 96° C.

When the result at step 500 is affirmative (THW≧96° C.), step 502 is performed. Step 502 sets the radiator fan relay flag YFAN at one.

If the radiator fan relay flag YFAN is set at one at the step 502, the ECU 26 outputs the low-state signal to the inductor 22*b* of the radiator fan relay 22. When the radiator fan system is normally operating and no malfunction occurs, the rotation of the cooling fan 18 is started immediately by outputting the low-state signal to the inductor 22*b* of the radiator fan relay 22.

On the other hand, when the result at step 500 is negative (THW<96° C.), step 504 is performed. Step 504 detects whether the radiator fan relay flag YFAN is equal to 1.

When the result at step 504 is affirmative (YFAN=1), step 506 is performed. It is determined that the engine 10 is currently cooled by the cooling fan 18. Step 506 detects whether the cooling water temperature (THW) indicated by the signal from the water temperature sensor 32 is above 94.5° C. When the result at step 506 is affirmative (THW≧94.5° C.), it is determined that the engine 10 has not been cooled to a sufficiently low temperature. Step 510 that will be described later is performed at this time, and the radiator fan relay flag YFAN is maintained at 1.

When the result at step 504 is negative (YFAN not equal to 1), or when the result at step 506 is negative (THW<94.5° C.), step 508 is performed. It is determined that the rotation of the cooling fan 18 is not needed. Step 508 sets the radiator fan relay flag YFAN at zero (YFAN=0).

If the radiator fan relay flag YFAN is set at zero, the ECU 26 outputs the high-state signal to the inductor 22*b* of the radiator fan relay 22. When the radiator fan relay 22, the fan motor 20, and the connection between the elements are normal and no malfunction occurs, the switching device 22*a* of the radiator fan relay 22 is turned OFF. Accordingly, the rotation of the cooling fan 18 is stopped immediately by outputting the high-state signal to the inductor 22*b* of the radiator fan relay 22.

According to the above procedure, the rotation of the cooling fan 18 is continuously stopped until the cooling water temperature (THW) is raised to the upper limit temperature 96° C. If the cooling water temperature (THW) reaches 96° C., the rotation of the cooling fan 18 is started and maintained until the cooling water temperature (THW) is lowered to the lower limit temperature 94.5° C. Since the rotation of the cooling fan 18 is thus controlled, the cooling water temperature (THW) is maintained in the range between the lower limit temperature and the upper limit temperature (94.5° C.–96° C.).

After one of steps 502, 506 and 508 is performed, step 510 is performed by the ECU 26. Step 510 detects whether the non-start failure flag XFANJS is equal to 1. When the result at step 510 is negative (XFANJS not equal to 1), step 512 is performed. It is determined that the non-start failure of the radiator fan system has not occurred. Step 512 sets a temporary non-start failure flag XFANFS0 at zero and sets a final non-start failure flag XFANFS at zero.

After step 512 is performed, step 514 is performed. Step 514 detects whether the non-stop failure flag XFANJA is equal to 1. When the result at the step 514 is negative (XFANJA not equal to 1), step 516 is performed. It is determined that the non-stop failure of the radiator fan system has not occurred. Step 516 sets a temporary non-stop failure flag XFANFA0 at zero and sets a final non-stop failure flag XFANFA at zero. After step 516 is performed, the malfunction detecting routine at the present cycle ends.

When the result at step 514 is affirmative (XFANJA=1), step 518 is performed. Step 518 detects whether the temporary non-stop failure flag XFANFA0 is equal to 1. When XFANFA0 is not equal to 1, step 520 is performed. Step 520 detects whether the time counter CFANJA is above 70 seconds. That is, it is determined at this step whether 70 seconds has elapsed after the non-stop failure flag XFANJA is set at one.

In the present embodiment, in order to ensure high accuracy of the malfunction detection, a malfunction detecting procedure for detecting the non-stop failure of the radiator fan system is started after 70 seconds have elapsed since the time the non-stop failure flag XFANJA is set at one. When the result at step 520 is negative (CFANJA<70 seconds), step 516 is performed and then the routine at the present cycle ends.

When the result at step 520 is affirmative (CFANJA≧70 seconds), step 522 is performed which will be described later.

On the other had, when the result at step 518 is affirmative (XFANFA0=1), step 522 is performed and step 520 is not performed. That is, when the temporary non-stop failure flag XFANFA0 is already set at 1, the malfunction detecting procedure starting from step 522 is performed immediately without detecting whether the time counter CFANJA is above 70 seconds.

Step 522 sets the time counter CFANJA at zero (CFANJA=0). After step 522 is performed, step 524 sets an initial temperature value THW0A at the value of the cooling water temperature THW when 70 seconds have elapsed since the time the non-stop failure flag XFANJA is set at 1. That is, the cooling water temperature THW at that time is stored in the memory of the ECU 26 as the initial temperature value THW0A.

As previously described with reference to FIG. 6, the non-stop failure flag XFANJA is set at one when the cooling water temperature THW is below 90° C. In this case, since steps 500 through 508 are already performed, a control signal to stop the rotation of the cooling fan 18 is output to the radiator fan relay 22 if the non-stop failure flag XFANJA is set at one.

If the non-stop failure of the radiator fan system has not occurred, it can be determined that the initial temperature value THW0A indicates the cooling water temperature THW which is derived due to the natural cooling with the running air.

If the non-stop failure of the radiator fan system has occurred, it can be determined that the initial temperature value THW0A indicates the cooling water temperature THW which is derived due to the forced cooling. The forced cooling is performed by setting the radiator fan relay flag YFAN at one and rotating the cooling fan 18 for 70 seconds after the condition of THW<90° C. is detected. In the present embodiment, since the forced cooling is continuously performed for 70 seconds, it is supposed that the cooling water temperature THW is lowered to the lower saturation temperature. Therefore, if the non-stop failure of the radiator fan system has occurred, the lower saturation temperature is stored at step 524 in the memory of the ECU 26 as the temperature value THW0A.

After step 524 is performed, step 526 is performed. Step 526 forcedly sets the radiator fan relay flag YFAN at one, in order to perform the forced cooling by the cooling fan 18. If the non-stop failure of the radiator fan system has not occurred, the rotation of the cooling fan 18 is started at this time. However, if the non-stop failure of the radiator fan system has occurred, the rotation of the cooling fan 18 is continued regardless of whether the radiator fan relay flag YFAN is forcedly set at one at this step.

After step 526 is performed, step 528 is performed. Step 528 sets the time counter CFANON at zero. The time counter CFANON is automatically incremented for every second since the time the radiator fan relay flag YFAN is forcedly set at one. Thus, the time counter CFANON indicates the elapsed time after the radiator fan relay flag YFAN is forcedly set at one. After step 528 is performed, step 530 detects whether the time counter CFANON is above 35 seconds. Step 530 is repeated until the condition of CFANON≧35 seconds is detected.

After the condition of CFANON≧35 seconds is detected at step 530, step 532 is performed. Step 532 sets a 35-second-after temperature value THW35A at the value of the cooling water temperature THW when 35 seconds have elapsed since the time the radiator fan relay flag YFAN is forcedly set at one. That is, the cooling water temperature THW at that time is stored in the memory of the ECU 26 as the 35-second-after temperature value THW35A.

After step 532 is performed, step 534 is performed. Step 534 detects whether a temperature change DLTHWA (=THW0A–THW35A), that is the difference between the initial temperature value THW0A and the 35-second-after temperature value THW35A, is greater than 1.0.

If the radiator fan system is normally operating and the non-stop failure of the radiator fan system has not occurred, the cooling water temperature THW is considerably lowered by the forced cooling performed by forcedly setting the radiator fan relay flag YFAN at one. In this case, the temperature value THW35A is distinctly lower than the temperature value THW0A, and the temperature change DLTHWA (=THW0A–THW35A) should be greater than 1.0.

If the non-stop failure of the radiator fan system has occurred, the cooling water temperature THW is not considerably changed after the radiator fan relay flag YFAN is forcedly set at one. In this case, the temperature values THW0A and THW35A are almost the same, and the temperature change DLTHWA (=THW0A–THW35A) should not be greater than 1.0.

Therefore, when the result at the step 534 is affirmative (DLTHWA>1.0), it is determined that the non-stop failure of the radiator ran system has not occurred. The step 516 is performed, and the malfunction detecting routine at the present cycle ends.

On the other hand, when the result at step 534 is negative (DLTHWA≦1.0), it is determined that the non-stop failure of the radiator fan system has occurred. In this case, step 536 detects whether the temporary non-stop failure flag XFANFA0 is equal to 1.

When the result at step 536 is negative (XFANFA0 not equal to 1), step 538 sets the temporary non-stop failure flag XFANFAO at one. After step 538 is performed, the malfunction detecting routine at the present cycle ends.

When the result at step 536 is affirmative (XFANFA0=1), step 540 sets the final non-stop failure flag XFANFA at one. After step 540 is performed, the malfunction detecting routine at the present cycle ends.

According to the above procedure, the final non-stop failure flag XFANFA is set at one when the result at step 534 is negative (DLTHWA≦1.0) at two consecutive cycles after 70 seconds have elapsed since the time the non-stop failure flag XFANJA is set at one. In the present embodiment, the above procedure is carried out in order to ensure the correctness of the malfunction detection and avoid an erroneous determination.

When the final non-stop failure flag XFANFA is set at one as the result of the above malfunction detection routine, the ECU 26 outputs the ON-state signal to the driver circuit 40. The warning lamp 38 is turned ON to give a warning of the non-stop failure of the radiator fan system to the vehicle operator.

In the present embodiment, the above procedure is carried out in order to ensure high accuracy of the malfunction detection. However, the present invention is not limited to this embodiment. It may be possible to modify the present embodiment so that the final non-stop failure flag XFANFA is set at one when the result at step 534 is negative (DLTHWA≦1.0) at first.

Next, a description will be given how the malfunction detecting apparatus of the second embodiment detects the non-start failure of the radiator fan system with reference to FIG. 8.

When the result at the step 510 is affirmative (XFANJS=1), step 542 is performed. It is determined at this time that the non-stop failure of the radiator fan system has not occurred, but there is a possibility that the non-start failure of the radiator fan system has occurred. Step 542 sets the temporary non-stop failure flag XFANFA0 at zero and sets the non-stop failure flag XFANFA at zero.

After the step 542 is performed, step 544 is performed. Step 544 detects whether the temporary non-start failure flag XFANFS0 is equal to 1.

When the result at the step 544 is negative (XFANFS0 not equal to 1), step 546 is performed. Step 546 detects whether the time counter CFANJS is above 70 seconds. That is, it is determined at this step whether 70 seconds have elapsed after the non-start failure flag XFANJS is set at one.

Similarly to the previous embodiment, in the present embodiment, in order to ensure high accuracy of the malfunction detection, a malfunction detecting procedure for detecting the non-start failure of the radiator fan system is started after 70 seconds have elapsed since the time the non-start failure flag XFANJS is set at one. When the result at the step 546 is negative (CFANJS<70 seconds), step 548 is performed. Step 548 sets the temporary non-start failure flag XFANFS0 at zero and sets the final non-start failure flag XFANFS at zero. After the step 548 is performed, the malfunction detecting routine at the present cycle ends.

When the result at the step 546 is affirmative (CFANJS≧70 seconds), step 550 is performed which will be described later.

On the other hand, when the result at the step 544 is affirmative (XFANFS0=1), step 550 is performed and the step 546 is not performed. That is, when the temporary non-start failure flag XFANFS0 is already set at 1, the malfunction detecting procedure starting from the step 550 is performed immediately without detecting whether the time counter CFANJS is above 70 seconds.

Step 550 sets the time counter CFANJS at zero (CFANJS=0). After step 550 is performed, step 552 sets an initial temperature value THW0S at the value of the cooling water temperature THW when 70 seconds have elapsed since the time the non-start failure flag XFANJS is set at 1. That is, the cooling water temperature THW at that time is stored in the memory of the ECU 26 as the initial temperature value THW0S.

As previously described with reference to FIG. 6, the non-start failure flag XFANJS is set at one when the cooling water temperature THW is above 98° C. In this case, since steps 500 through 508 are already performed, a control signal to start the rotation of the cooling fan 18 is output to the radiator fan relay 22 if the non-start failure flag XFANJS is set at one.

If the non-start failure of the radiator fan system has not occurred, it can be determined that the initial temperature value THW0S indicates the cooling water temperature THW which is derived due to the forced cooling by the cooling fan 18.

If the non-start failure of the radiator fan system has occurred, it can be determined that the initial temperature value THW0S indicates the cooling water temperature THW which is derived due to the natural cooling performed for 70 seconds after the condition of THW>98° C. is detected.

In the present embodiment, since the natural cooling is continuously performed for 70 seconds after the condition of THW>98° C. is detected, it is supposed that the cooling water temperature THW is raised to the upper saturation temperature. Therefore, if the non-start failure of the radiator fan system has occurred, the upper saturation temperature is stored at the step 552 in the memory of the ECU 26 as the initial temperature value THW0S.

After step 552 is performed, step 554 is performed. Step 554 forcedly sets the radiator fan relay flag YFAN at zero, in order to stop the rotation of the cooling fan 18 and perform the natural cooling. If the non-start failure of the radiator fan system has not occurred, the rotation of the cooling fan 18 is stopped at this time. However, if the non-start failure of the radiator fan system has occurred, the non-rotated condition of the cooling fan 18 is continued regardless of whether the radiator fan relay flag YFAN is forcedly set at zero at this step.

After step 554 is performed, step 556 is performed. Step 556 sets a time counter CFANOF at zero. The time counter CFANOF is automatically incremented for every second since the time the radiator fan relay flag YFAN is forcedly set at zero. Thus, the time counter CFANOF indicates the elapsed time after the radiator fan relay flag YFAN is forcedly set at zero. After step 556 is performed, step 558 detects whether the time counter CFANOF is above 35 seconds. The step 558 is repeated until the condition of CFANOF≧35 seconds is detected.

After the condition of CFANOF≧35 seconds is detected at step 558, step 560 is performed. Step 560 sets a 35-second-after temperature value THW35S at the value of the cooling water temperature THW when 35 seconds have elapsed since the time the radiator fan relay flag YFAN is forcedly set at zero. That is, the cooling water temperature THW at that time is stored in the memory of the ECU 26 as the 35-second-after temperature value THW35S.

After step 560 is performed, step 562 is performed. Step 562 detects whether a temperature change DLTHWS (=THW0S−THW35S), that is the difference between the initial temperature value THW0S and the 35-second-after temperature value THW35S, is smaller than −1.0.

If the radiator fan system is normally operating and the non-start failure of the radiator fan system has not occurred, the cooling water temperature THW is considerably raised by forcedly setting the radiator fan relay flag YFAN at zero. In this case, the temperature value THW35S is distinctly greater than the temperature value THW0S, and the temperature change DLTHWS (=THW0S−THW35S) should be smaller than −1.0. In other words, the absolute value of the temperature change DLTHWS in this case should be greater than 1.0.

If the non-start failure of the radiator fan system has occurred, the cooling water temperature THW is not considerably changed after the radiator fan relay flag YFAN is forcedly set at zero. In this case, the temperature values THW0S and THW35S are almost the same, and the temperature change DLTHWS (=THW0S−THW35S) should not be smaller than −1.0. In other words, the absolute value of the temperature change DLTHWS in this case should be smaller than 1.0.

Therefore, when the result at step 562 is affirmative (DLTHWS<−1.0), it is determined that the non-start failure of the radiator fan system has not occurred. Step 548 is performed, and the malfunction detecting routine at the present cycle ends.

On the other hand, when the result at step 562 is negative (DLTHWS≧1.0), it is determined that the non-start failure of the radiator fan system has occurred. In this case, step 564 detects whether the temporary non-start failure flag XFANFS0 is equal to 1.

When result at step 564 is negative (XFANFS0 not equal to 1), step 566 sets the temporary non-start failure flag XFANFS0 at one. After step 566 is performed, the malfunction detecting routine at the present cycle ends.

When the result at step 564 is affirmative (XFANFS0=1), step 568 sets the final non-start failure flag XFANFS at one. After step 568 is performed, the malfunction detecting routine at the present cycle ends.

According to the above procedure, the final non-start failure flag XFANFS is set at one when the result at step 562 is negative (DLTHWS≧1.0) at two consecutive cycles (or after 70 seconds have elapsed since the time the non-start failure flag XFANJS is set at one). In the present embodiment, the above procedure is carried out in order to ensure the correctness of the malfunction detection and avoid an erroneous determination.

When the final non-start failure flag XFANFS is set at one as the result of the above malfunction detection routine, the ECU 26 outputs the ON-state signal to the driver circuit 40. The warning lamp 38 is turned ON to give a warning of the non-start failure of the radiator fan system to the vehicle operator.

In the present embodiment, the above procedure is carried out in order to ensure high accuracy of the malfunction detection. However, the present invention is not limited to this embodiment. It may be possible to modify the present embodiment so that the final non-start failure flag XFANFS is set at one immediately when the result at step 562 is negative (DLTHWS≧−1.0) at first.

FIGS. 9A through 9G show an operation of the malfunction detecting apparatus of the second embodiment to detect the non-stop failure of the radiator fan system. In FIGS. 9A through 9G, a change of state when the radiator fan system is normally operating is indicated by a solid line, and a change of a state when the non-stop failure of the radiator fan system has occurred or when the radiator fan relay flag YFAN is forcedly set at one is indicated by a one-dotted chain line.

Figures 9A, 9B, 9C, 9D, 9E, 9F, 9G:
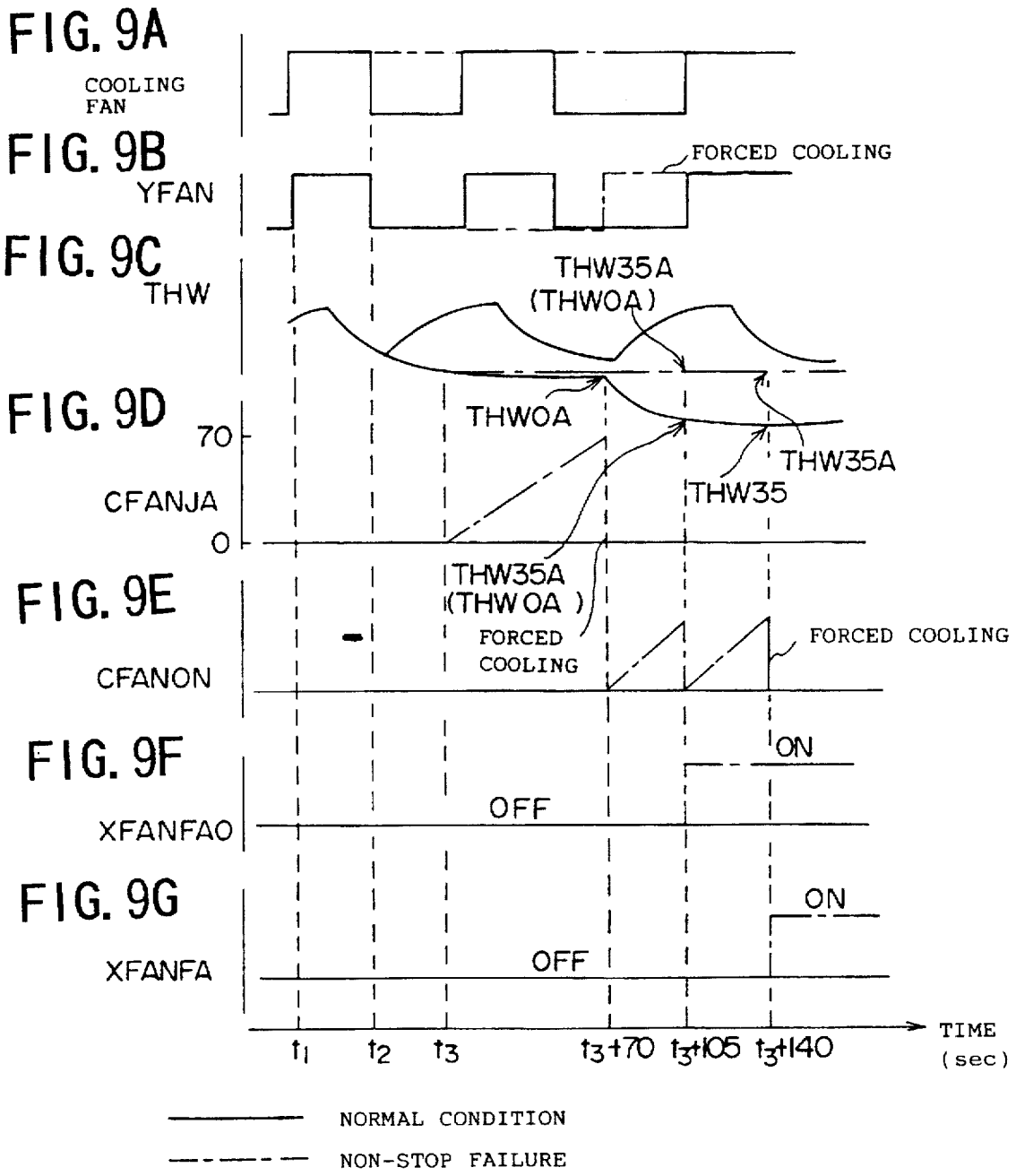
FIGS. 9A through 9G are time charts for explaining an operation of the malfunction detecting apparatus of the second embodiment.

FIG. 9A shows the change of the operation of the cooling fan 18, and FIG. 9B shows the change of the radiator fan relay flag YFAN. If the radiator fan system is normally operating, when the radiator fan relay flag YFAN changes from 0 to 1 at the time (t1) and changes from 1 to 0 at the time (t2), the cooling fan 18 starts rotation at the time (t1) and stops rotation at the time (t2) in response to the changes of the radiator relay flag YFAN.

If the non-stop failure of the radiator fan system has occurred, when the radiator fan relay flag YFAN changes from 1 to 0 at the time (t2), the cooling fan 18 does not stop rotation and continues to rotate.

FIG. 9C shows the change of the cooling water temperature THW, FIG. 9D shows the change of the time counter CFANJA, and FIG. 9E shows the change of the time counter CFANON. If the radiator fan system is normally operating and the cooling fan 18 stops the rotation at the time (t2), the cooling water temperature THW is slightly lowered due to the heat radiation delay and is thereafter raised by the stop of the rotation of the cooling fan 18. In this case, the radiator fan relay flag YFAN is again set at one when the cooling water temperature THW exceeds 96° C. Then, the operation of the cooling fan 18 is controlled so that the cooling water temperature THW is maintained in the range between the lower limit temperature and the upper limit temperature (94.5° C.–96° C.).

If the non-stop failure of the radiator fan system has occurred and the cooling fan 18 does not stop the rotation at the time (t2), the cooling water temperature THW is continuously lowered to the lower saturation temperature as shown in FIG. 9C.

Similarly, if the cooling ability due to the natural cooling is sufficient, the cooling water temperature THW is continuously lowered after the rotation of the cooling fan 18 is stopped at the time (t2).

When the cooling water temperature THW is below 90° C. at the time (t3), the incrementing of the time counter CFANJA is started as shown in FIG. 9D. When the time counter CFANJA is equal to 70 seconds at the time (t3+70), the radiator fan relay YFAN is forcedly set at one as shown in FIG. 9B. The value of the cooling water temperature THW at the time (t3+70) is stored in the memory of the ECU 26 as the THW0A, and at the same time the incrementing of the time counter CFANON is started as shown in FIG. 9E. When the time counter CFANON is equal to 35 seconds at the time (t3+105), the value of the cooling water temperature THW at this time is stored in the memory of the ECU 26 as the THW35A.

If the non-stop failure of the radiator fan system has occurred, both the stored values THW0A and THW35A are equal to the lower saturation temperature which is derived by the forced cooling. In this case, the difference between the stored values THW0A and THW35A is almost equal to zero.

If the non-stop failure has not occurred and the cooling water temperature THW is below 90° C. due to the natural cooling, the stored values THW0A and THW35A are different from each other. The stored value THW0A is equal to the lower saturation temperature which is derived by the natural cooling, and the stored value THW35A is equal to a further lowered temperature which is derived by the forced cooling. For this reason, the stored value THW35A is distinctly lower than the stored value THW0A.

FIG. 9F shows the change of the temporary non-stop failure flag XFANFA0, and FIG. 9G shows the change of the non-stop failure flag XFANFA. If the radiator fan system is normally operating, the cooling water temperature THW always varies so as to meet the condition of THW0A>THW35A as described above. In this case, the temperature change DLTHWA (=THW0A–THWB5A) is always a positive value. The temporary non-stop failure flag XFANFAO and the non-stop failure flag XFANFA are maintained at 0.

If the non-stop failure of the radiator fan system has occurred, the cooling water temperature THW remains almost unchanged and the stored values THW0A and THW35A are nearly the same as described above. In this case, the temperature change DLTHWA is nearly equal to zero. The temporary non-stop failure flag XFANFAO is set at 1 at the time (t3+105) when 35 seconds have elapsed since the time (t3+70) the radiator fan relay flag YFAN is forcedly set at 1. The non-stop failure flag XFANFA is set at 1 at the time (t3+140) when additional 35 seconds have elapsed since the time (t3+105).

Accordingly, it is possible for the present embodiment to correctly detect the non-stop failure of the radiator fan system in accordance with the change in the cooling water temperature THW with high accuracy. The malfunction detecting apparatus of the present embodiment does not require the special detecting unit for detecting a malfunction in the radiator fan system. Therefore, the present embodiment provides a low cost a malfunction detecting apparatus which can accurately detect the non-stop failure of the radiator fan system.

It is readily understood that the malfunction detecting apparatus of the present embodiment comprises a steady-state discrimination unit, a rotation stopping unit, a temperature change measuring unit, and a malfunction detecting unit. Steps 300 through 306 in FIG. 5 and the step 408 in FIG. 6 are performed by the ECU 26 to achieve the steady-state discrimination unit. Steps 510 and 554 in FIG. 8 are performed by the ECU 26 to achieve the rotation stopping unit. Step 552 and steps 556 through 560 in FIG. 8 are performed by the ECU 26 to achieve the temperature change measuring unit. Steps 562 through 568 in FIG. 8 are performed by the ECU 26 to achieve the malfunction detecting unit.

Further, it is readily understood that the radiator fan system to which the present embodiment is applied comprises a cooling fan control unit controlling the cooling fan 18 by outputting a control signal to the radiator fan relay 22. Steps 500 through 508 in FIG. 8 are performed by the ECU 26 to achieve the cooling fan control unit.

FIGS. 10A through 10G show an operation of the malfunction detecting apparatus of the second embodiment to detect the non-start failure of the radiator fan system. In FIGS. 10A through 10G, a change of a state when the radiator fan system is normally operating is indicated by a solid line, and a change of a state when the non-start failure of the radiator fan system has occurred or when the radiator fan relay flag YFAN is forcedly set at zero is indicated by a one-dotted chain line.

Figures 10A, 10B, 10C, 10D, 10E, 10F, 10G:
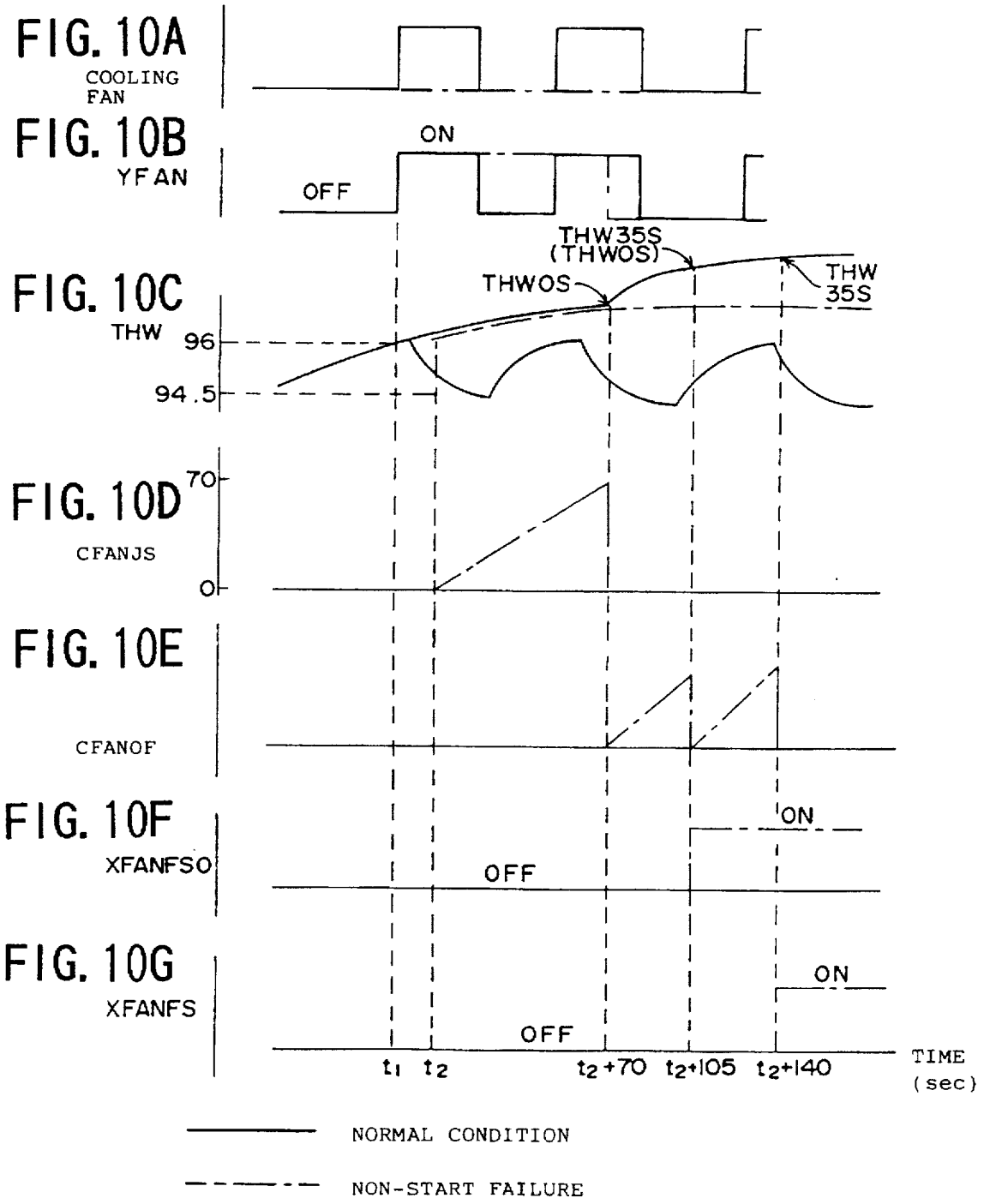
FIGS. 10A through 10G are time charts for explaining an operation of the malfunction detecting apparatus of the second embodiment.

FIG. 10A shows the change of the operation of the cooling fan 18, and FIG. 10B shows the change of the radiator fan relay flag YFAN. If the radiator fan system is normally operating, when the radiator fan relay flag YFAN changes from 0 to 1 at the time (t1), the cooling fan 18 starts rotation at the time (t1) in response to the change of the radiator fan relay flag YFAN.

If the non-start failure of the radiator fan system has occurred, when the radiator fan relay flag YFAN changes from 0 to 1 at the time (t1), the cooling fan 18 does not start rotation at the time (t1) and continues to be in the non-rotated condition.

FIG. 10C shows the change of the cooling water temperature THW, FIG. 10D shows the change of the time counter CFANJS, and FIG. 9E shows the change of the time counter CFANOF. If the radiator fan system is normally operating and the cooling fan 18 starts the rotation at the time (t1), the cooling water temperature THW is slightly raised due to the heat radiation delay, and thereafter is gradually lowered by the rotation of the cooling fan 18. Then, the operation of the cooling fan 18 is controlled so that the cooling water temperature THW is maintained in the range between the lower limit temperature and the upper limit temperature (94.5° C.–96° C.).

If the non-start failure of the radiator fan system has occurred and the cooling fan 18 does not start the rotation at the time (t1), the cooling water temperature THW is continuously raised to the upper saturation temperature due to the non-rotated condition as shown in FIG. 10C.

Similarly to the above non-start failure case, when the vehicle stops running after running at high speed for a long time, there is a case in which the cooling water temperature THW is continuously raised after the time (T1) even though the radiator fan system is normally operating.

When the cooling water temperature THW is continuously raised and exceeds 98° C. at the time (t2), the incrementing of the time counter CFANJS is started as shown in FIG. 10D. When the time counter CFANJS is equal to 70 seconds at the time (t2+70), the radiator fan relay flag YFAN is forcedly set at zero as shown in FIG. 10B. The value of the cooling water temperature THW at the time (t2+70) is stored in the memory of the ECU 26 as the THW0S, and at the same time the incrementing of the time counter CFANOF is started as shown in FIG. 10E. When the time counter CFANOF is equal to 35 seconds at the time (t2+105), the value of the cooling water temperature THW at this time is stored in the memory of the ECU 26 as the THW35S.

If the non-start failure of the radiator fan system has occurred, both the stored values THW0S and THW35S are equal to the upper saturation temperature which is derived by the natural cooling. In this case, the difference between the stored values THW0S and THW35S is almost equal to zero.

If the non-start failure has not occurred and the cooling water temperature THW is above 98° C. in spite of the forced cooling, the stored values THW0S and THW35S are different from each other. The stored value THW0S is equal to the upper saturation temperature which is derived by the forced cooling, and the stored value THW35S is equal to a further raised temperature which is derived by the stop of the forced cooling. For this reason, the stored value THW35S is distinctly higher than the stored value THW0S.

FIG. 10F shows the change of the temporary non-start failure flag XFANFS0, and FIG. 10G shows the change of the non-start failure flag XFANFS. If the radiator fan system is normally operating, the cooling water temperature THW always varies so as to meet the condition of THW0S THW35S as described above. In this case, the temperature change DLTHWS (=THW0S–THW35S) is always a negative value. The temporary non-start failure flag XFANFS0 and the non-start failure flag XFANFS are maintained at 0.

If the non-start failure of the radiator fan system has occurred, the cooling water temperature THW remains almost unchanged and the stored values THW0S and THW35S are nearly the same as described above. In this case, the temperature change DLTHWS is nearly equal to zero. The temporary non-start failure flag XFANFS0 is set at 1 at the time (t2+105) when 35 seconds have elapsed since the time (t2+70) the radiator fan relay flag YFAN is forcedly set at zero. The non-start failure flag XFANFS is set at 1 at the time (t2+140) when additional 35 seconds have elapsed since the time (t2+105).

Accordingly, it is possible for the present embodiment to correctly detect the non-start failure of the radiator fan system in accordance with the change in the cooling water temperature THW with high accuracy. The malfunction detecting apparatus of the present embodiment does not require the special detecting unit for detecting a malfunction in the radiator fan system. Therefore, the present embodiment can provide a malfunction detecting apparatus which can accurately detect the non-start failure of the radiator fan system with low cost.

It is readily understood that the malfunction detecting apparatus of the present embodiment comprises a steady-state discrimination unit, a rotation starting unit, a temperature change measuring unit, and a malfunction detecting unit. Steps 300 through 306 in FIG. 5 and the step 408 in FIG. 6 are performed by the ECU 26 to achieve the steady-state discrimination unit. Steps 514 and 526 in FIG. 8 are performed by the ECU 26 to achieve the rotation starting unit. Step 524 and the steps 528 through 532 in FIG. 8 are performed by the ECU 26 to achieve the temperature change measuring unit. Steps 534 through 540 in FIG. 8 are performed by the ECU 26 to achieve the malfunction detecting unit.

Further, it is readily understood that the radiator fan system to which the present embodiment is applied comprises a cooling fan control unit controlling the cooling fan 18 by outputting a control signal to the radiator fan relay 22. Steps 500 through 508 in FIG. 8 are performed by the ECU 26 to achieve the cooling fan control unit.

What is claimed is:

1. An apparatus for detecting a malfunction in a radiator fan system which controls a cooling fan in response to a temperature of cooling water circulated in an internal combustion engine, comprising:

a fan controller for generating a control signal to start rotation of the cooling fan;

a temperature sensor for sensing the temperature of the cooling water; and a control unit for determining whether an operating condition of the engine is in a steady state, wherein the control unit, which is coupled to the temperature sensor, detects a malfunction in the radiator fan system when a change in the cooling water temperature is smaller than a reference value during a predetermined period of time during which the operating condition of the engine is in the steady state, wherein the predetermined period of time begins after the control signal is output.

2. The apparatus according to claim 1, further comprising a radiator fan relay coupled to the fan controller and wherein the fan controller outputs the control signal to the radiator fan relay.

3. The apparatus according to claim 1, wherein the control unit comprises:

first means for detecting whether an idle switch flag indicated by a signal output from an idle switch of the engine is equal to a predetermined value; and second means for detecting whether a vehicle speed indicated by a signal output from a vehicle speed sensor is below a predetermined reference speed.

4. The apparatus according to claim 1, wherein the predetermined time extends from a first time after the control signal is output to a second time after the first time and wherein the control unit determines whether the temperature change is greater than zero.

5. An apparatus for detecting a malfunction in a radiator fan system which controls a cooling fan in response to a temperature of cooling water circulated in an internal combustion engine, comprising:

a temperature sensor for sensing the temperature of the cooling water;

a control unit coupled to the temperature sensor, and the cooling fan, wherein the control unit detects whether an operating condition of the engine is in a steady-state and wherein the control unit controls the operation of the fan by outputting a first signal to start rotation of the fan and a second signal to stop rotation of the fan, wherein, when the operating condition of the engine is detected to be in the steady state and the first signal is output, the control unit outputs the second signal to stop rotation of the cooling fan and detects a malfunction in the radiator fan system when a change in the cooling water temperature is smaller than a reference value during a predetermined period of time after the rotation of the cooling fan is stopped.

6. The apparatus according to claim 5, further comprising a radiator fan relay, wherein the control unit further comprises a cooling fan controller which controls the cooling fan by outputting the first and second signal to the radiator fan relay.

7. The apparatus according to claim 5, wherein the control unit comprises:

first means for detecting whether a vehicle speed indicated by a signal output from a vehicle speed sensor is below a predetermined reference speed; and second means for detecting whether an idle switch flag indicated by a signal output from an idle switch of the engine is equal to a predetermined value.

8. The apparatus according to claim 5, wherein the predetermined time extends from a first time immediately after the rotation of the cooling fan is stopped to a second time after the first time and wherein the control unit determines whether the temperature change is greater than the reference value.

9. An apparatus for detecting a malfunction in a radiator fan system which controls a cooling fan in response to a temperature of cooling water circulated in an internal combustion engine, comprising:

a temperature sensor for sensing the temperature of the cooling water; and a control unit coupled to the temperature sensor and the cooling fan, wherein the control unit detects whether the engine is operating in a steady state condition and wherein the control unit generates a first fan control signal to start rotation of the cooling fan under normal operation and generates a second signal to start rotation of the cooling fan in a malfunction detection operation when the engine is operating in the steady state and the first signal is not presently output, wherein the control unit detects a malfunction in the radiator fan system when a change in the cooling water temperature is smaller than a reference value during a predetermined period of time after the rotation of the cooling fan is started by the second signal.

10. The apparatus according to claim 9, further comprising a radiator fan relay, wherein the control unit further comprises a cooling fan controller which controls the cooling fan by outputting the first and second signals to the radiator fan relay.

11. The apparatus according to claim 9, wherein the control unit comprises:

first means for detecting whether a vehicle speed indicated by a signal output from a vehicle speed sensor is below a predetermined reference speed; and second means for detecting whether an idle switch flag indicated by a signal output from an idle switch of the engine is equal to a predetermined value.

12. The apparatus according to claim 9, wherein the predetermined time extends from a first time immediately after the rotation of the cooling fan is started to a second time after the first time and wherein the control unit determines whether the temperature change is greater than the reference value.

13. The apparatus according to claim 9, further comprising a warning lamp coupled to the control unit, wherein the control unit operates to turn the warning lamp ON when a malfunction in the radiator fan system is detected, so that a warning of the malfunction is given to a vehicle operator.

14. The apparatus according to claim 9, further comprising a warning lamp coupled to the control unit via a driver circuit, wherein the control unit outputs an ON signal to the driver circuit when a malfunction in the radiator fan system is detected.

15. The apparatus according to claim 9, wherein a final failure flag is set by the control unit at a predetermined value after a determination that the change in the cooling water temperature for two consecutive cycles is smaller than the reference value.

* * * * *

UNITED STATES PATENT AND TRADEMARK OFFICE

CERTIFICATE OF CORRECTION

PATENT NO. : 5,738,049
DATED : April 14, 1998
INVENTOR(S) : Masahito NINOMIYA

It is certified that error appears in the above-identified patent and that said Letters Patent is hereby corrected as shown below:

Column 2, lines 51 and 52, delete "The above-mentioned objects of the present invention are achieved by" and insert --Alternatively, the present invention is directed to--.

Column 2, line 61, after "change" change "measures" to --measuring-- and after "unit" change "measuring" to --measures--.

Column 3, line 8, delete "a" after "cost".

Column 3, line 18, delete "a" after "cost".

Column 3, line 66, delete "a" after "which".

Column 4, line 13, delete "where".

Column 4, line 47, change "stop" to --stops--.

Column 4, line 54, change "AT" to --At--.

Column 4, line 55, change "start" to --stops--.

Column 7, line 46, delete "the".

Column 8, line 12, delete "the" before "step".

UNITED STATES PATENT AND TRADEMARK OFFICE

CERTIFICATE OF CORRECTION

PATENT NO. : 5,738,049

DATED : April 14, 1998

INVENTOR(S) : Masahito NINOMIYA

It is certified that error appears in the above-identified patent and that said Letters Patent is hereby corrected as shown below:

Column 11, line 7, delete "a" at end of line.

Column 11, line 9, delete "with." at end of line.

Column 20, line 15, insert --the-- before "result".

Column 20, line 25, change "1.0" to -1.0--.

Column 20, line 50, delete "a".

Column 22, line 12, delete "a" after "cost".

Column 23, line 45, after "THWOS" insert --<--

Column 24, line 12, delete "the".

Column 25, line 16, change "signal" to --signals--.

Signed and Sealed this

First Day of December, 1998

Bruce Lehman

*Attest:*

BRUCE LEHMAN

*Attesting Officer*

*Commissioner of Patents and Trademarks*